US010688370B2

(12) United States Patent
Judge

(10) Patent No.: US 10,688,370 B2
(45) Date of Patent: Jun. 23, 2020

(54) TRAINING DEVICE FOR BALL SPORTS

(71) Applicant: GLOBALTEC INNOVATION LTD, Colchester (GB)

(72) Inventor: Daniel Judge, Suffolk (GB)

(73) Assignee: GLOBALTEC INTERNATIONAL LTD., Colchester (GB)

( * ) Notice: Subject to any disclaimer, the term of this patent is extended or adjusted under 35 U.S.C. 154(b) by 0 days.

(21) Appl. No.: 16/320,741

(22) PCT Filed: Jul. 27, 2017

(86) PCT No.: PCT/GB2017/000117
§ 371 (c)(1),
(2) Date: Jan. 25, 2019

(87) PCT Pub. No.: WO2018/020200
PCT Pub. Date: Feb. 1, 2018

(65) Prior Publication Data

US 2019/0176009 A1 Jun. 13, 2019

(30) Foreign Application Priority Data

Jul. 28, 2016 (GB) ..... 1613019.7

(51) Int. Cl.
*A63B 69/40* (2006.01)
*A63B 69/00* (2006.01)
*A63B 47/04* (2006.01)

(52) U.S. Cl.
CPC ..... *A63B 69/406* (2013.01); *A63B 69/002* (2013.01); *A63B 2047/043* (2013.01); *A63B 2069/401* (2013.01); *A63B 2069/402* (2013.01); *A63B 2069/403* (2013.01); *A63B 2069/404* (2013.01); *A63B 2069/405* (2013.01);

(Continued)

(58) Field of Classification Search
CPC ..... A63B 69/406; A63B 2243/0025; A63B 2210/50; A63B 2069/405; A63B 2069/404; A63B 2069/403; A63B 69/002; A63B 2069/402; A63B 2069/401; A63B 2047/043; A63B 2225/09
See application file for complete search history.

(56) References Cited

U.S. PATENT DOCUMENTS

2007/0149326 A1* 6/2007 York ..... A63B 47/002 473/438
2014/0261362 A1* 9/2014 Boehner ..... A63B 69/406 124/78
2016/0193520 A1* 7/2016 Hart ..... A63B 69/40 124/78

OTHER PUBLICATIONS

International Search Report for PCT/GB2017/000117 dated Nov. 28, 2017, 5 pages.

* cited by examiner

*Primary Examiner* — Jeffrey S Vanderveen
(74) *Attorney, Agent, or Firm* — Klintworth & Rozenblat IP LLP

(57) ABSTRACT

A training device for ball sports comprises a launching structure comprising an aperture sized and shaped to allow balls to pass linearly through the aperture along the central axis of the aperture, and a launching means configured to contact a ball within the aperture at a plurality of contact locations spaced around the surface of the ball, and to drive the ball through the aperture, and; a supporting means configured to support the launching structure above a surface; the launching structure and supporting means configured such that in use the launching structure can be rotated about the central axis to alter the position of the contact locations.

20 Claims, 18 Drawing Sheets

(52) U.S. Cl.
CPC ..... *A63B 2210/50* (2013.01); *A63B 2225/09* (2013.01); *A63B 2243/0025* (2013.01)

TRAINING DEVICE FOR BALL SPORTS

FIELD

The present invention relates to a training device for ball sports. More particularly, the present invention relates to a compact, low-weight training device for ball sports that can be easily transported and set up as and where required.

BACKGROUND

Ball sports such as soccer are extremely popular, and are played by organised teams at every level from local club to international. Skillful players are able to control the ball to the extent of adding spin to the ball as well as an initial velocity, so that the ball changes direction or curves while in flight. This is advantageous in many situations—for example, in soccer this allows a player to make indirect shots, bypassing intervening obstacles in line-of-sight between the player and their target, so that the player can shoot or pass to another player on their team. However, it takes considerable practice for a receiving player to be able to control the ball delivered in this manner, and being able to 'read' a ball (accurately assess flight characteristics while the ball is in flight) is an important aspect of this. In order to be able to practice this, it is useful if a ball is launched at a player in substantially the same manner each time. In a normal grassroots or non-league training environment only around one-in-ten, to one-in-twenty balls actually arrive where they should from a corner kick taken by a player. Under these conditions the density of useful training is low and it can take considerable time for players to develop their skills.

It can also be useful, for example if training a goalkeeper or similar, to be able to shoot balls repeatedly and swiftly, from a variety of angles and at a variety of speeds, so that they can practice their skills and hone their reflexes.

A number of machines are currently available that have ball launching functionality to allow users to practice specific skills the same as or similar to those outlined above. The Eurogoal machines by Globus Corporation are intended to provide goal shots, crosses and high arching shots, in order to train goalkeepers, defenders and strikers. The Sidekick soccer machine by Seattle Sports Science provides similar functionality, as does the Strikeattack machine by Sportsattack.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY

It is an object of the present invention to provide a training device for ball sports which goes some way to overcoming the abovementioned disadvantages or which at least provides the public or industry with a useful choice.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

Accordingly, in an aspect the present invention may broadly be said to consist in a training device for ball sports, comprising: a launching structure comprising an aperture sized and shaped to allow balls to pass linearly through the aperture along the central axis of the aperture, and a launching means configured to contact a ball within the aperture at a plurality of contact locations spaced around the surface of the ball, and to drive the ball through the aperture; a supporting means configured to support the launching structure above a surface; the launching structure and supporting means configured such that in use the launching structure can be rotated about the central axis to alter the position of the contact locations.

In an embodiment, the launching means comprises a plurality of launching wheels connected to the launching structure so that each wheel partly extends into the aperture to contact a ball therein, the wheels configured to rotate in use to drive the ball through the aperture.

In an embodiment, the plurality of launching wheels comprises a pair of launching wheels positioned within the launching structure so as to contact a ball at substantially diametrically opposed locations.

In an embodiment, the axis of rotation of each of the pair of launching wheels is substantially perpendicular to the central axis.

In an embodiment, the training device further comprises at least one motor configured to drive the pair of launching wheels.

In an embodiment, the at least one motor and launching wheels are configured so that the wheels can be driven at different speeds.

In an embodiment, the at least one motor comprises a pair of motors, one of each of the pair of motors associated with one of each of the launching wheels.

In an embodiment, the motor or motors is/are configured to provide a rotational speed of up to 4000 rpm to one or both of the launching wheels.

In an embodiment, each of the motors is rated substantially at 200 W.

In an embodiment, the spacing between the pair of launching wheels can be altered.

In an embodiment, the distance between the inner rims of the wheels can be altered substantially between 15 cm and 17.5 cm.

In an embodiment, the sides of the wheels are substantially straight.

In an embodiment, the sides of each of the wheels comprises a gripping means.

In an embodiment, the gripping means comprises a rubber layer.

In an embodiment, the rubber layer has a Shore Hardness substantially between 25 and 40.

In an embodiment, the gripping means comprises a saw tooth pattern around the perimeter of the wheel.

In an embodiment, the pattern is configured such that the ramp section of the saw tooth profile leads in use.

In an embodiment, the launching wheels are substantially H-shaped in cross-section, the outer sides of the upright of the 'H' forming the sides of the wheel.

In an embodiment, the launching wheels are shaped in profile can be shaped to have additional or increasing material towards the outer rim of the wheel.

In an embodiment, the launching wheels comprise a cross sectional profile that curves from the centre outwards towards the outer rim.

In an embodiment, the launching wheels comprise a stepped cross sectional profile from the centre outwards towards the perimeter circumference.

In an embodiment, the launching wheels each have a diameter of substantially 22-27 cm.

In an embodiment, the entry of the aperture is substantially circular.

In an embodiment, the entry aperture has a diameter of substantially 23 cm.

In an embodiment, the exit of the aperture is substantially circular and has a diameter of substantially 26.5 cm.

In an embodiment, the launching structure comprises a frame configured to form the aperture and extend to each side of the aperture.

In an embodiment, the frame is formed substantially from aluminium.

In an embodiment, the frame is formed substantially from plastics material.

In an embodiment, the training device further comprises a cover configured to connect with the frame to substantially enclose the frame except for the aperture.

In an embodiment, the supporting means and launching structure are mutually configured for removable connection.

In an embodiment, the supporting means comprises a stand configured to rest on a surface and extend upwards from the surface to connect with and support the launching structure.

In an embodiment, the stand has a height of substantially between 25 cm and 60 cm.

In an embodiment, the stand is configured to allow at least one battery to be mounted on the stand to provide power to the launching structure.

In an embodiment, the frame further comprises a circular segment connected to the frame so that the segment is located slightly rearwards of the aperture.

In an embodiment, the circular segment comprises a ring.

In an embodiment, the stand further comprises a plurality of bearings, configured to connect with the circular segment to detachably mount the launching structure on the stand, and allow the launching structure to be rotated about the central axis to alter the position of the contact locations.

In an embodiment, the bearings are formed and mounted on the stand so that at least in use a channel is formed into which the outer edge of the segment can be located, the segment movable within the channel to rotate the launching structure.

In an embodiment, each of the bearings is formed so as to appear circular in front or rear view, and H-shaped in side view, the width of the channel of the H substantially the same as the thickness of the segment.

In an embodiment, the stand further comprises a mounting loop, the bearings connected to the face of the mounting loop.

In an embodiment, eight bearings are arranged in pairs along the length of the mounting loop, each connected so as to rotate around a central axis of rotation.

In an embodiment, the stand and mounting loop are configured so that the mounting loop can be rotated in both the horizontal and vertical planes.

In an embodiment, the launching structure further comprises at least one spindle connecting between the at least one motor and the launching wheels, the spindle or spindles and wheels mutually configured to allow the wheels to be removed and replaced.

In an embodiment, the training device further comprises at least one bolt, the wheel and spindle configured to be bolted together.

In an embodiment, the training device further comprises a ball feed configured to connect with the mounting loop to form a feed ramp for balls that extends rearwards from the aperture and which is configured to feed balls along the ramp into the aperture.

In an embodiment, the ball feed comprises a half-tube, angled forwards and downwards in use.

In an embodiment, the mounting loop comprises a plurality of pins, extending rearwards from the mounting loop, the ball feed further comprising a flange that extends downwards to rest against the rear of the mounting loop in use, the flange comprising a plurality of apertures corresponding to the plurality of pins, the pins and apertures forming a keyhole mechanism to allow the ball feed to be mounted to the mounting loop.

In an embodiment, the ball feed comprises at least a section comprising a full ring, the full ring comprising a tube of moisture-absorbing material configured to wipe across the surface of a ball passing through the full ring.

In an embodiment, the tube of moisture-absorbing material comprises a plurality of grommets spaced around the perimeter at one end thereof, the full ring comprising a corresponding plurality of threaded extensions that extend rearwards from the ring, in use the grommets located onto the threaded extensions to be held in place by nuts.

In a second aspect the present invention may broadly be said to consist in a training device for ball sports, comprising: comprising: a launching structure comprising an aperture sized and shaped to allow balls to pass linearly through the aperture along the central axis of the aperture, and a launching means configured to contact a ball within the aperture at a plurality of contact locations spaced around the surface of the ball, and to drive the ball through the aperture; a supporting means configured to support the launching structure above a surface; the launching structure and supporting means mutually configured for removable connection.

In an embodiment, the connection between the launching structure and supporting means is configured such that the launching structure can be rotated about the central axis to alter the position of the contact locations.

In an embodiment, the connection between the launching structure and supporting means is configured such that the axis of rotation of the launching is substantially identical to the central axis.

In an embodiment, the supporting means comprises a stand configured to rest on a surface and extend upwards from the surface to connect with and support the launching structure.

In an embodiment, the stand has a height of substantially between 25 cm and 60 cm.

In an embodiment, the stand is configured to allow at least one battery to be mounted on the stand to provide power to the launching structure.

In an embodiment, the launching means comprises a plurality of launching wheels connected to the launching structure so that each wheel partly extends into the aperture to contact a ball therein, the wheels configured to rotate in use to drive the ball through the aperture.

In an embodiment, the plurality of launching wheels comprises a pair of launching wheels positioned within the launching structure so as to contact a ball at substantially diametrically opposed locations.

In an embodiment, the axis of rotation of each of the pair of launching wheels is substantially perpendicular to the central axis.

In an embodiment, the training device further comprises at least one motor configured to drive the pair of launching wheels.

In an embodiment, the at least one motor and launching wheels are configured so that the wheels can be driven at different speeds.

In an embodiment, the at least one motor comprises a pair of motors, one of each of the pair of motors associated with one of each of the launching wheels.

In an embodiment, the motor or motors is/are configured to provide a rotational speed of up to 4000 rpm to one or both of the launching wheels.

In an embodiment, each of the motors is rated substantially at 200 W.

In an embodiment, the spacing between the pair of launching wheels can be altered.

In an embodiment, the distance between the inner rims of the wheels can be altered substantially between 15 cm and 17.5 cm.

In an embodiment, the sides of the wheels are substantially straight.

In an embodiment, the sides of each of the wheels comprises a gripping means.

In an embodiment, the gripping means comprises a rubber layer.

In an embodiment, the rubber layer has a Shore Hardness substantially between 25 and 40.

In an embodiment, the launching wheels are shaped in profile can be shaped to have additional or increasing material towards the outer rim of the wheel.

In an embodiment, the launching wheels comprise a cross sectional profile that curves from the centre outwards towards the outer rim.

In an embodiment, the launching wheels comprise a stepped cross sectional profile from the centre outwards towards the perimeter circumference.

In an embodiment, the launching wheels are substantially H-shaped in cross-section, the outer sides of the upright of the 'H' forming the sides of the wheel.

In an embodiment, the launching wheels each have a diameter of substantially 22-27 cm.

In an embodiment, the aperture is substantially circular.

In an embodiment, the aperture has a diameter of substantially 23 cm.

In an embodiment, the launching structure comprises a frame configured to form the aperture and extend to each side of the aperture.

In an embodiment, the frame is formed substantially from aluminium.

In an embodiment, the frame is formed substantially from plastics material.

In an embodiment, the training device further comprises a cover configured to connect with the frame to substantially enclose the frame except for the aperture.

In an embodiment, the frame further comprises a circular segment connected to the frame so that the segment is located slightly rearwards of the aperture.

In an embodiment, the circular segment comprises a ring.

In an embodiment, the stand further comprises a plurality of bearings, configured to connect with the circular segment to detachably mount the launching structure on the stand, and allow the launching structure to be rotated about the central axis to alter the position of the contact locations.

In an embodiment, the bearings are formed and mounted on the stand so that at least in use a channel is formed into which the outer edge of the segment can be located, the segment movable within the channel to rotate the launching structure.

In an embodiment, the stand further comprises a mounting loop, the bearings connected to the face of the mounting loop.

In an embodiment, each of the bearings is formed so as to appear circular in front or rear view, and H-shaped in side view, the width of the channel of the H substantially the same as the thickness of the segment.

In an embodiment, eight bearings are arranged in pairs along the length of the mounting loop, each connected so as to rotate around a central axis of rotation.

In an embodiment, the stand and mounting loop are configured so that the mounting loop can be rotated in both the horizontal and vertical planes.

In an embodiment, the launching structure further comprises at least one spindle connecting between the at least one motor and the launching wheels, the spindle or spindles and wheels mutually configured to allow the wheels to be removed and replaced.

In an embodiment, the training device further comprises at least one bolt, the wheel and spindle configured to be bolted together.

In an embodiment, the training device further comprises a ball feed configured to connect with the mounting loop to form a feed ramp for balls that extends rearwards from the aperture and which is configured to feed balls along the ramp into the aperture.

In an embodiment, the ball feed comprises a half-tube, angled forwards and downwards in use.

In an embodiment, the mounting loop comprises a plurality of pins, extending rearwards from the mounting loop, the ball feed further comprising a flange that extends downwards to rest against the rear of the mounting loop in use, the flange comprising a plurality of apertures corresponding to the plurality of pins, the pins and apertures forming a keyhole mechanism to allow the ball feed to be mounted to the mounting loop.

In an embodiment, the ball feed comprises at least a section comprising a full ring, the full ring comprising a tube of moisture-absorbing material configured to wipe across the surface of a ball passing through the full ring.

In an embodiment, the tube of moisture-absorbing material comprises a plurality of grommets spaced around the perimeter at one end thereof, the full ring comprising a corresponding plurality of threaded extensions that extend rearwards from the ring, in use the grommets located onto the threaded extensions to be held in place by nuts.

With respect to the above description then, it is to be realised that the optimum dimensional relationships for the parts of the invention, to include variations in size, weight, materials, shape, form, function and manner of operation, assembly and use, are deemed readily apparent and obvious to one skilled in the art, and all equivalent relationships to those illustrated in the drawings and described in the specification are intended to be encompassed by the present invention.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE FIGURES

Further aspects of the invention will become apparent from the following description which is given by way of example only and with reference to the accompanying drawings which show an embodiment of the device by way of example, and in which.

DETAILED DESCRIPTION

An embodiment of a training device for ball sports of the present invention will now be described with reference to the figures.

The training device 1 of this embodiment is intended for use with soccer balls, for the practice of soccer skills. However, it should be noted that the scope of the invention is not limited to soccer, and that other embodiments could be used for other ball sports without departing from the scope of the invention.

The training device 1 has two main parts: a base section 2 and a launching section 3.

Base Section

Figure 1A:
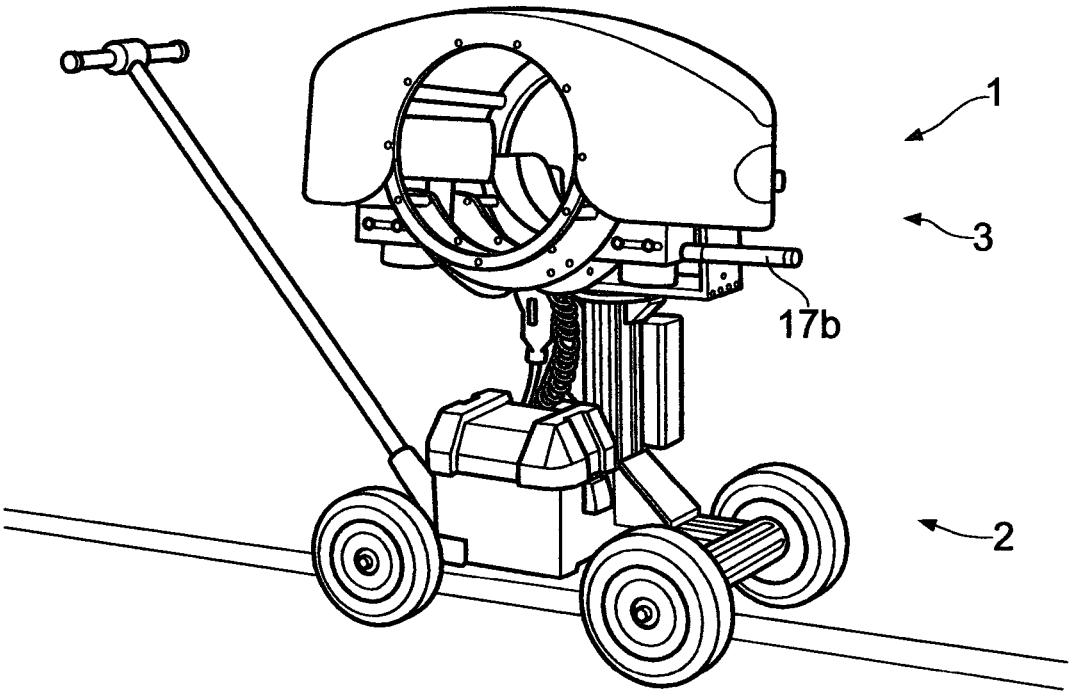
FIG. 1*a* shows a view from in front of and to one side of a training device according to an embodiment of the present invention, the training device having a base section, and a detachable launching section that in use and as shown mounts on to the base section, the base section having wheels to allow the base section to be moved to a required location, the launching section independently adjustable on the base section to allow balls to be launched over a range of angles, speeds and directions, the launching section having a casing that covers the internal working parts in use.
Figure 1B:
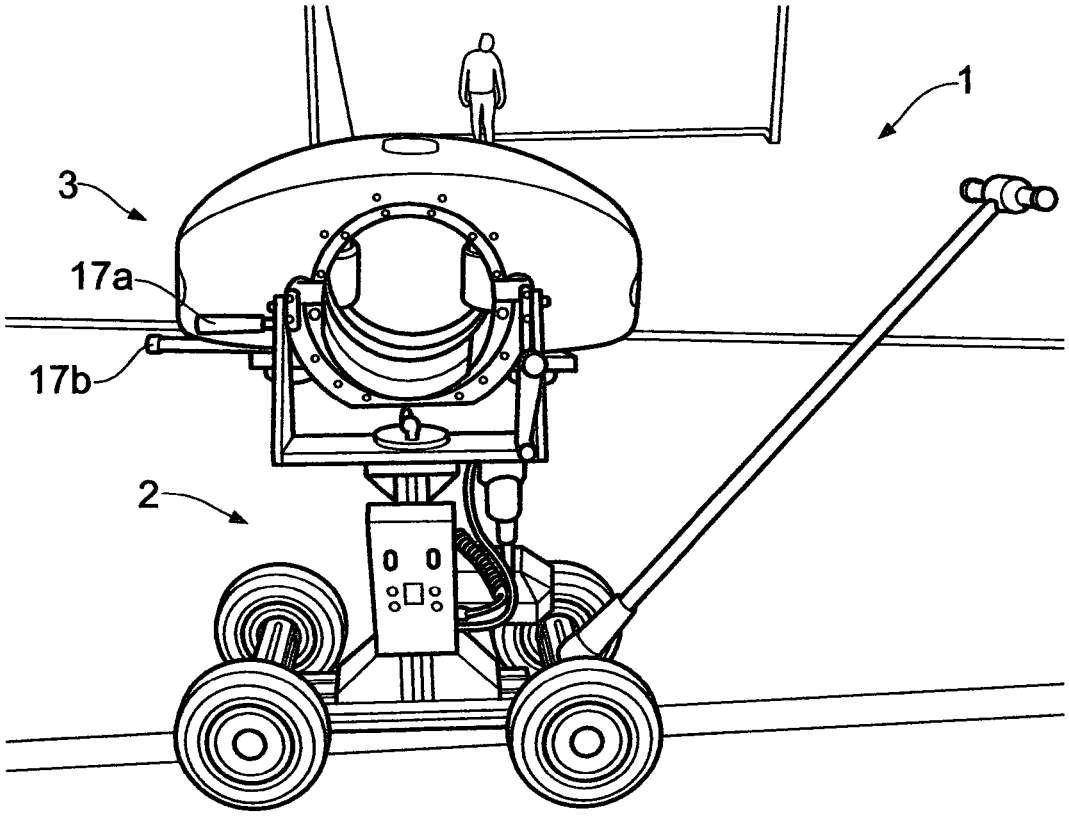
FIG. 1*b* shows a view from directly behind looking forwards of the training device of FIG. 1*a*.
Figure 1C:
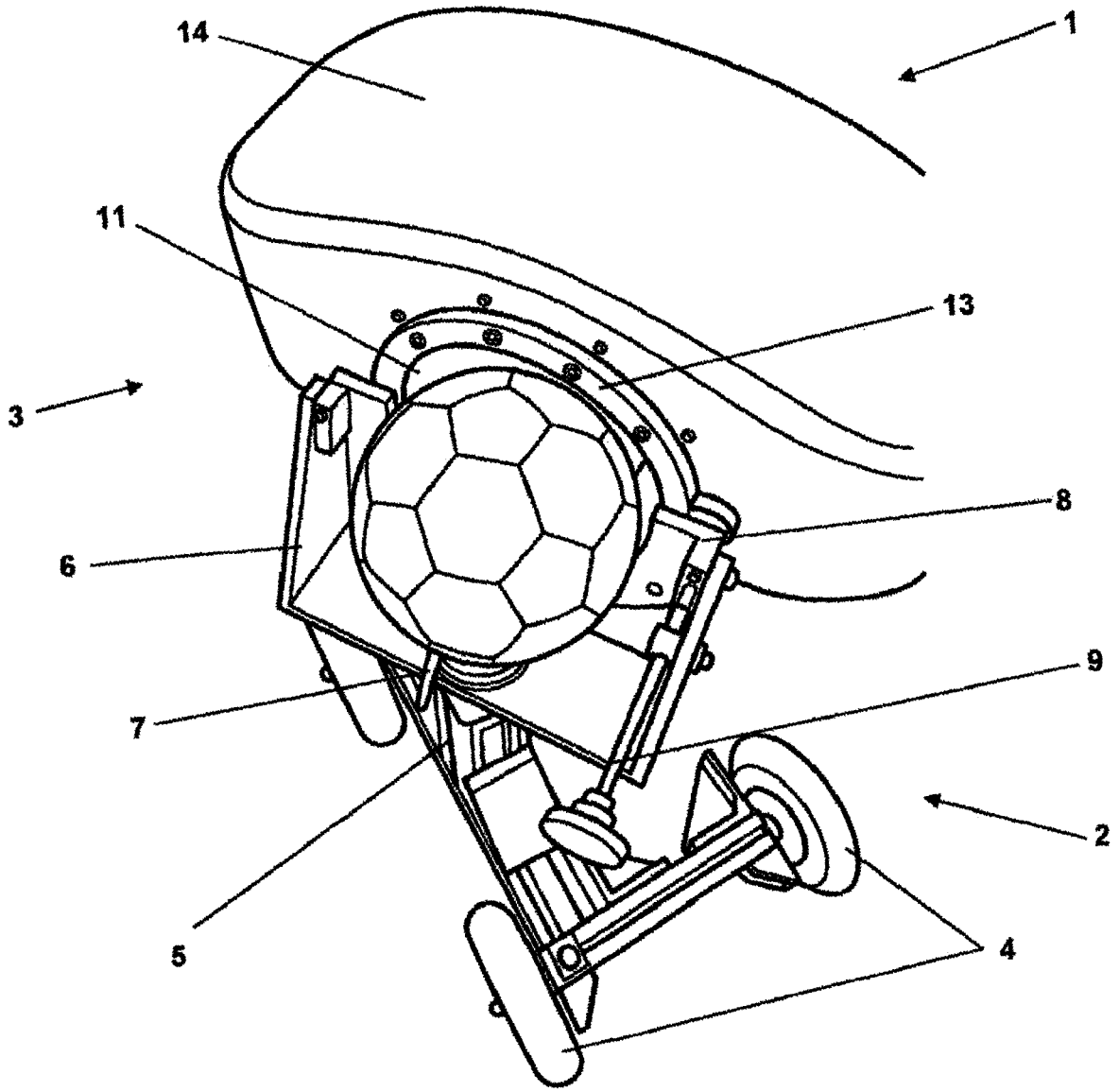
FIG. 1*c* shows a top-down perspective view from slightly behind of the training device of FIGS. 1*a* and 1*b*, showing detail of the base section, and the launching section, the launching section shown rotated at an angle around a vertical axis in comparison to FIGS. 1*a* and 1*b*.
Figure 2:
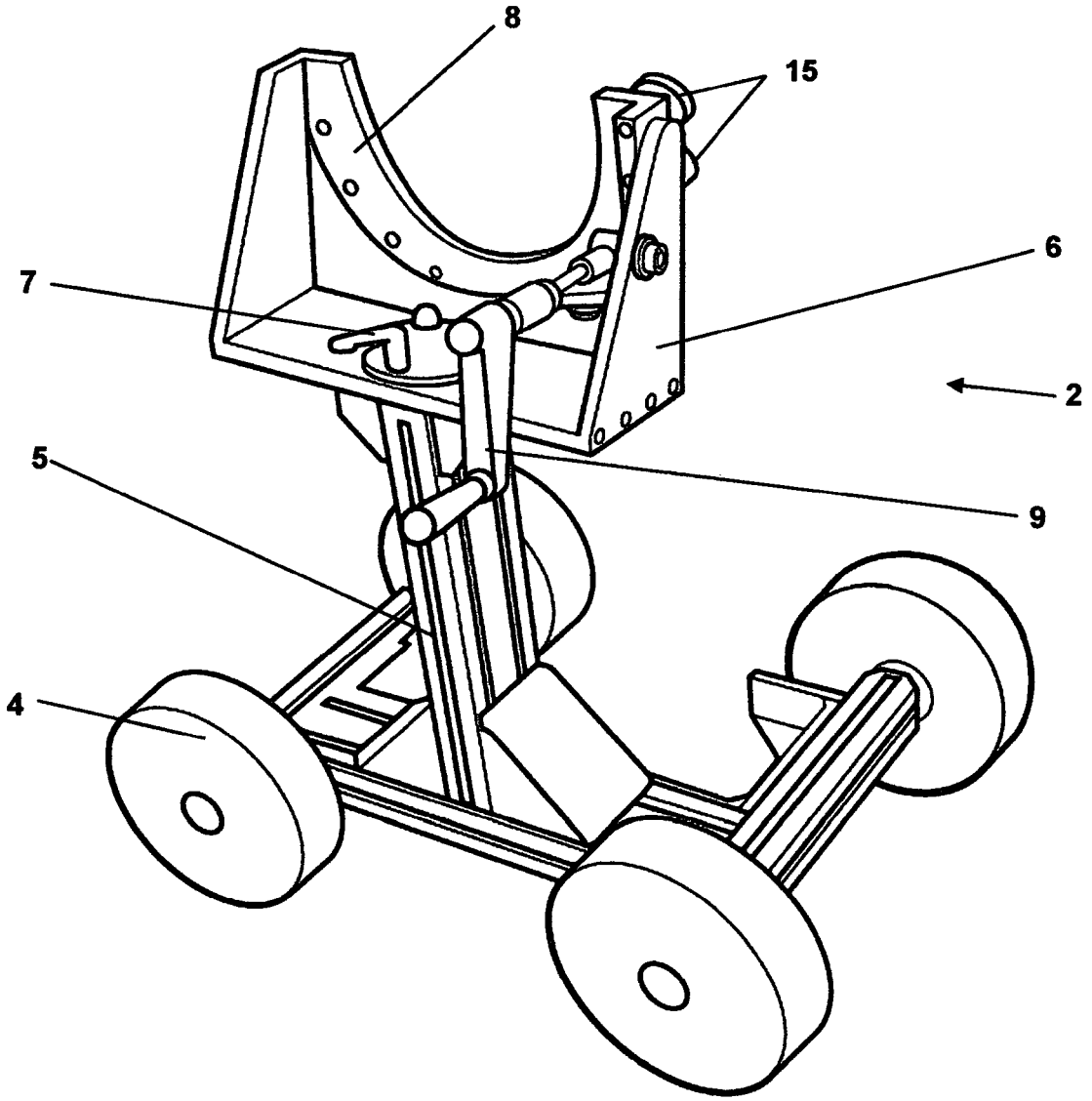
FIG. 2 shows a view of the base section from behind, with the launching section removed and not present, showing detail of a vertical mounting pole that extends upwards from the lower part of the base section, and a U-shaped connection section rotatably mounted to the top of the mounting pole, with a semi-circular mounting loop connected to the squared off U-shaped connection section, the connection between the ends of the 'U' and the mounting loop forming a pivoting connection so that the mounting loop can be rotated up/down, via manipulation of a handle.

The base section 2 comprises an aluminium frame, generally appearing as a squared-off C-shape in plan view, as shown in FIGS. 1 and 2, the open side of the 'C' facing forwards. Four wheels 4 are connected to the frame, two at the two corners where the longer 'upright' of the C meets the shorter sides, and two at the other ends of the shorter sides. Items such as a control unit and a battery or batteries can be mounted on the lower part of the frame as required.

An upright mounting pole 5 extends substantially vertically upwards from substantially the centre of the long 'upright' side of the C. The upright mounting pole 5 is between 25 cm and 35 cm in length (height). The base section forms a stand for the launching section in use.

A squared off U-shaped connection section 6 is mounted to the top of the upright mounting pole 5, the underside of the base of the connection section 6 connecting with the top of the mounting pole 5 at substantially the mid-point of the base. The connection is a rotating connection, so that the connection section 6 can be rotated from side-to-side (in the horizontal plane, around a vertical axis that runs down the centre of the mounting pole 5) to around 45 degrees each side of a central bisecting line that bisects the base section 2 in plan view. The rotational position of the connection section 6 can be locked, in this embodiment by a friction lock activated by way of handle 7 on the connection section 6.

A semi-circular mounting loop 8 is connected to the squared off U-shaped connection section 6, the ends of the 'U' generally congruent with the ends of the mounting loop 8, so that the semi-circle of the mounting loop extends downwards into the 'U', between the ends of the 'U'. The connection between the ends of the 'U' and the semi-circle is a pivoting connection, the axis of rotation or axis of pivot aligned horizontally, so that the mounting loop 8 can be rotated up/down, or backwards/forwards. A combination worm gear and handle 9 is connected to the connection section 6 at one side, so that rotation of the handle 9 causes rotation of the mounting loop 8 about the horizontal pivot axis (elevation). The handle 9 as shown for this embodiment is a crank handle, but could be a knob, or any other suitable type of handle.

Figure 3A:
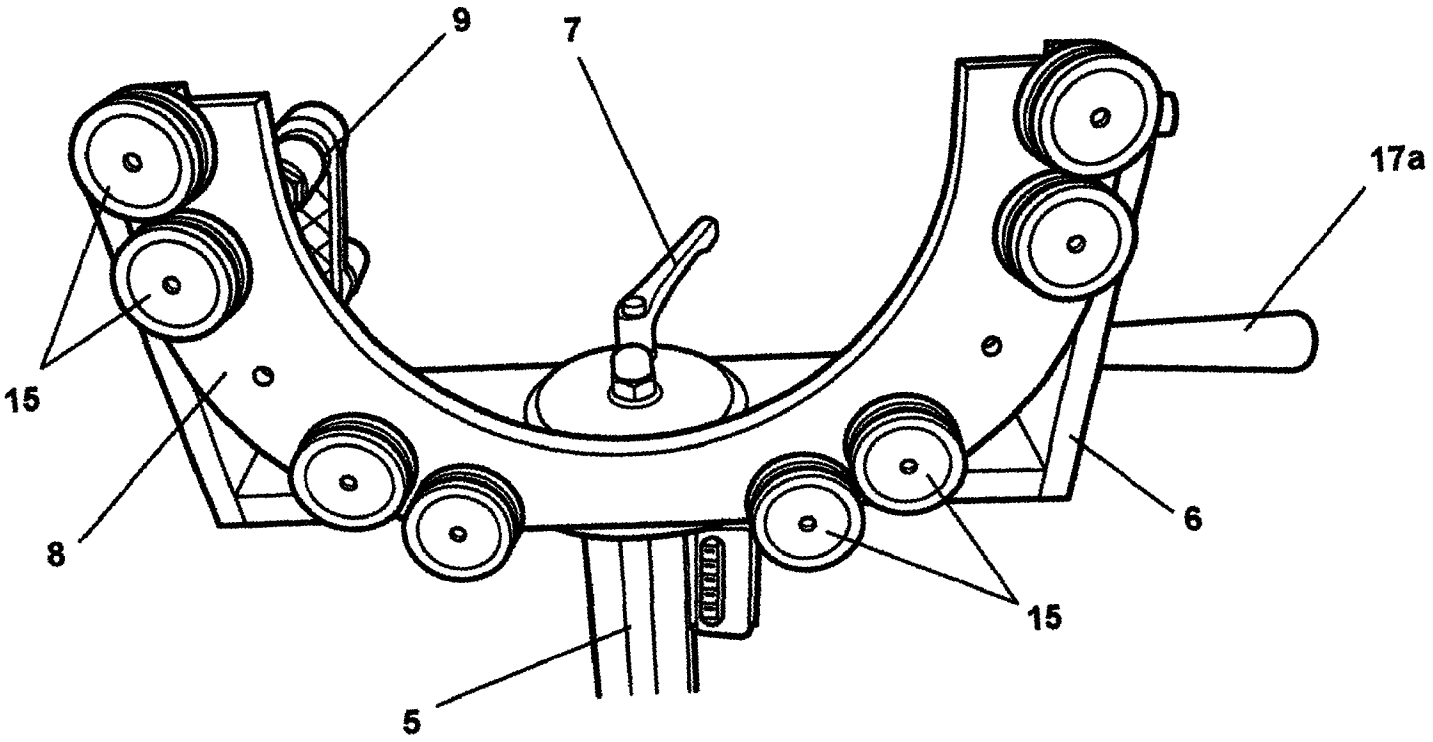
FIG. 3*a* shows a view from in front and slightly above of the top part of the base section, showing detail of the semi-circular mounting loop and eight mounting bearings rotatably connected to the front face of the mounting loop over the length of the loop, to allow the launching section to be rotatably mounted to the base section.
Figure 3B:
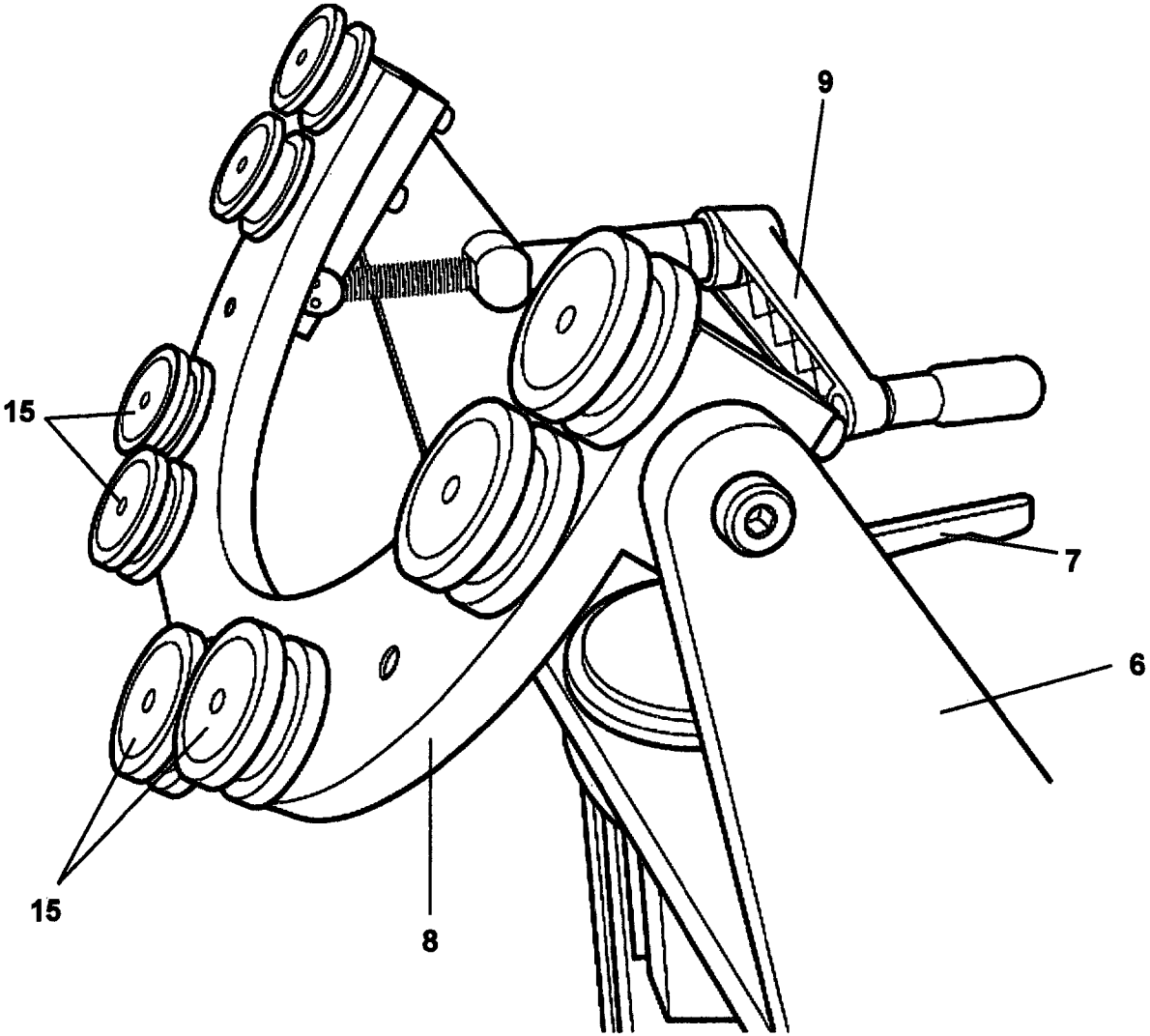
FIG. 3*b* shows a view from the side and slightly above of the mounting loop and mounting bearings, the loop pivoted upwards and forwards to a position that in use with the launching section present would allow balls to be launched with a high angled trajectory, adjustment of the angle of the mounting loop carried out via a handle and associated worm gear shown to the rear of the mounting loop on the base section.
Figure 4:
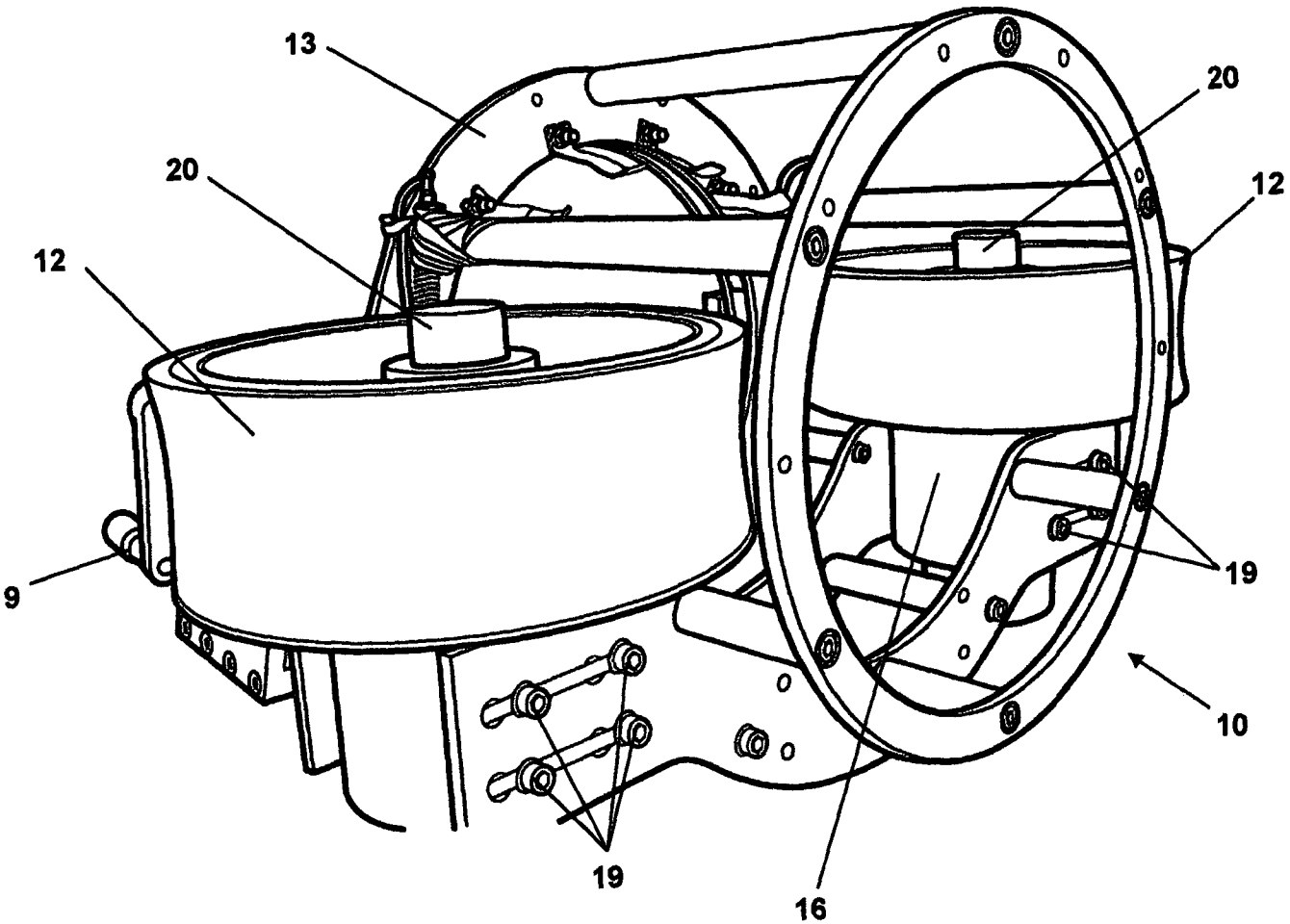
FIG. 4 shows a view from the opposite side to that in FIG. 3*b*, of the launching section in position on the base section and horizontally aligned, the launching section shown without a cover in order to show detail of a frame that forms the central structure of the launching section, the frame having a central aperture through which balls pass in use, the frame extending to each side of the central aperture, a pair of launching wheels that drive balls through the aperture fitted to the frame at each side of the aperture.
Figure 5A:
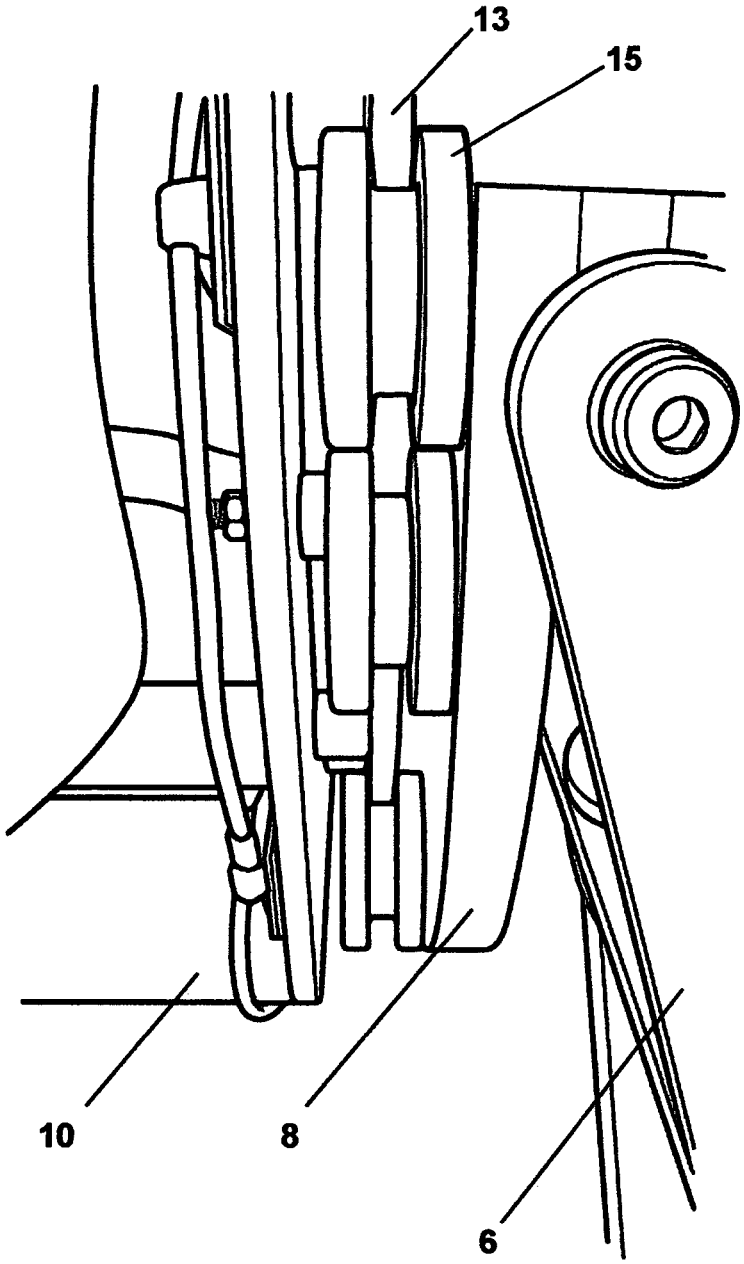
FIG. 5*a* shows a detail side view of a hollow loop that forms the rear opening of the aperture of the frame of the launching section, and the rollers and mounting loop, the rollers having an H-shape in side view, the loop slotting into the top groove of the h-shape of the rollers to hold the launching section in position and to allow this to be pivoted or rotated from side-to-side about a pivot axis that runs through the centre of the aperture.
Figure 5B:
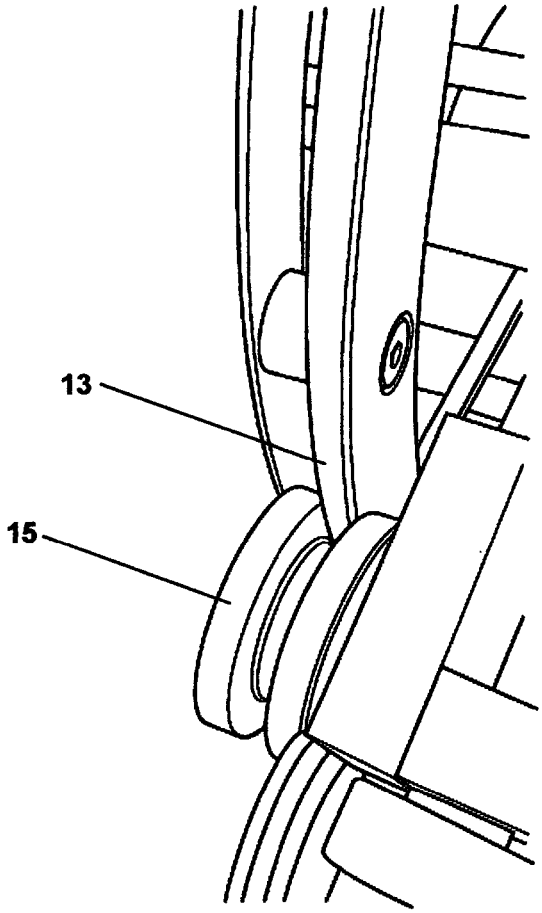
FIG. 5*b* shows a close-up perspective view from behind and to the side of the loop slotted into a roller.

Eight mounting bearings 15 are connected to the front face of the mounting loop 8, arranged in pairs at substantially even intervals from one end to the other of the mounting loop, as shown in FIG. 3*a*. The mounting bearings are circular when viewed from the front (that is, horizontally from the front when the mounting loop 8 is directly vertically aligned), and are connected to so as to rotate both clockwise and anticlockwise when viewed from the front. From directly to the side, each of the mounting bearings 15 appears H-shaped. The central portion and the larger front and rear portions of each of the bearings 15 are circular (or cylindrical sections). It should be noted that different numbers of bearings could be used: for example six, four or even three bearings could be used. Also, these do not have to be grouped in pairs.

The material from which the bearings 15 are formed is acetyl.

The launching section 3 is mounted to the base section 2 in use, as described in detail below.

Launching Section

Figure 11:
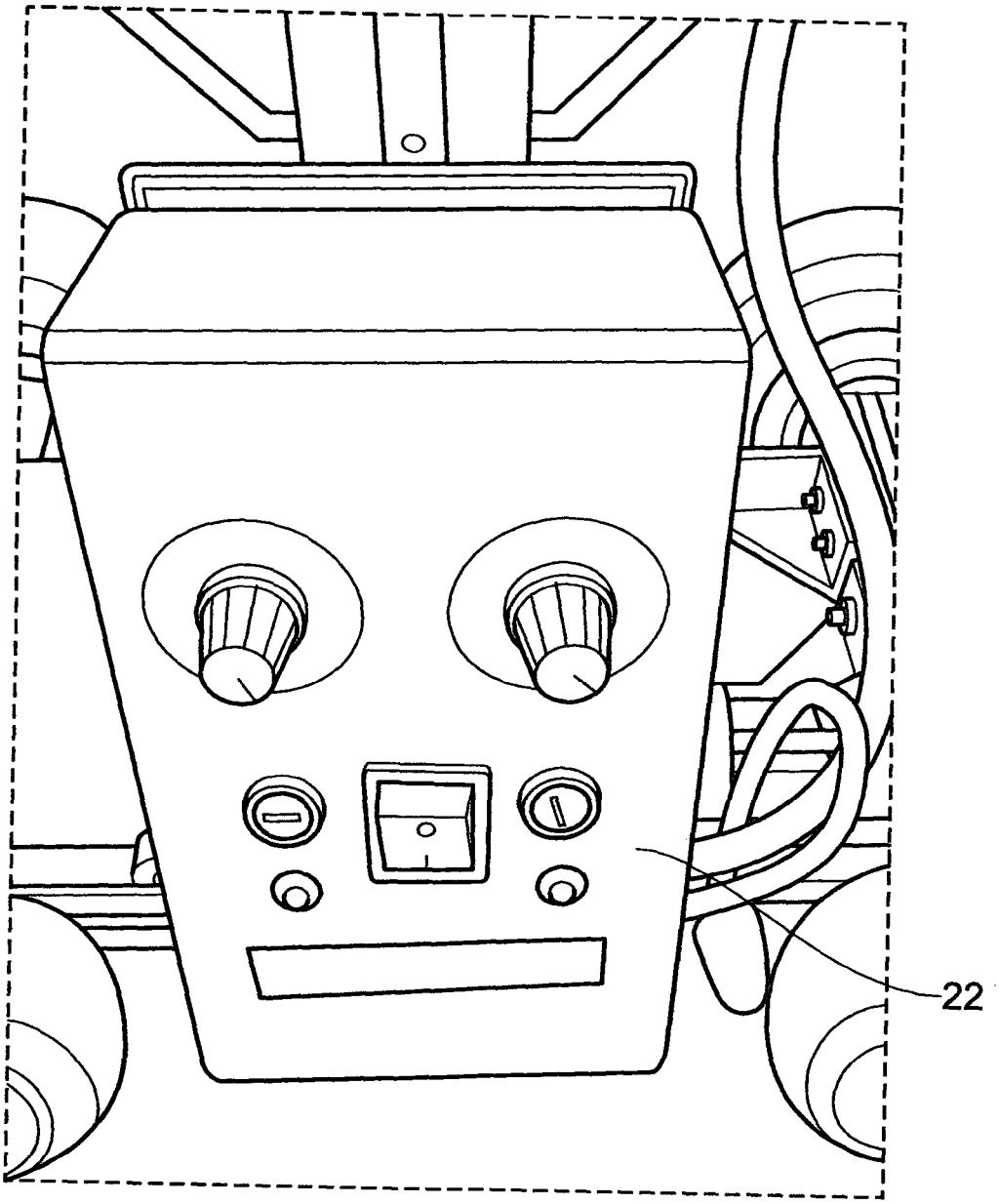
FIG. 11 shows a view of a controller for the training device, the controller having an on/off switch and independent speed controls to allow adjustment of the speed of each of the wheels independently.

The launching section 3 has a central frame 10. In the preferred embodiment, this is formed from aluminium, but could be formed from steel, plastic or any other suitable material. The frame has a central circular tunnel or aperture 11, having an entry ring at the rear (where the balls enter) that has a diameter of substantially 23 cm, and 26.5 cm at the front side (where the ball exits), with the frame extending each side of the central aperture 11. A pair of driving or launching wheels 12 are mounted on the frame 10, each side of the aperture 11. The launching wheels 12 are cylindrical and have a diameter several times their height. The launching wheels 12 extend slightly inwards into the aperture 11 from the sides of the aperture 11. The launching wheels 12 can be moved inwards and outwards, either linked, or independently, to alter the distance between the inner sides of the launching wheels 12 within the aperture 11, and the distance which the launching wheels 12 extend into the aperture 11. In this embodiment, each of the launching wheels are mounted on rails, the rails held in place by bolts 19 once in the desired position. Alternatively, the rails could be held in place by a quick-release clamp or clamps so that the distance can be adjusted. In this embodiment, the distance between the inner rims or firing rims of the wheels can be altered or adjusted between 15 cm and 17.5 cm. The launching wheels are rotationally connected to the frame 10, the axis of rotation of each of the launching wheels perpendicular to the central axis of the aperture 11 (i.e. if the aperture is horizontally aligned, the rotational axes of the launching wheels 12 will be vertically aligned). The launching wheels 12 are driven by motors 16 located on the frame 10, one motor for each of the launching wheels 12, the motors 16 located under the launching wheels and on/across the pivot axis of the associated launching wheel. The motors 16 are connected to the launching wheels 12 via spindles 20 so that these rotate in opposite directions (viewed from the rear and above, the left-hand wheel rotates anti-clockwise, and the right-hand wheel rotates clockwise), so that a ball will be driven along and through the aperture 11 as it passes into the aperture 11 and contacts the launching wheels 12. The motors 16 are powered by a battery or batteries mounted on the base section 2, connected to the motor(s) via wires. The battery is preferably a 12V car battery or similar. The speed of the motor(s) can be adjusted to alter the speed of rotation of the launching wheels 12 via a control unit 22 also mounted on the base section 2. The motors in a first embodiment rated up to 200 W and 3000 rpm. However, more powerful motors can be used to allow speeds of 4000 rpm or greater. The control unit 22 is shown in FIG. 11, and has an on/off switch and control to independently adjust the speed of each of the motors and in turn the firing wheels.

Figure 8A:
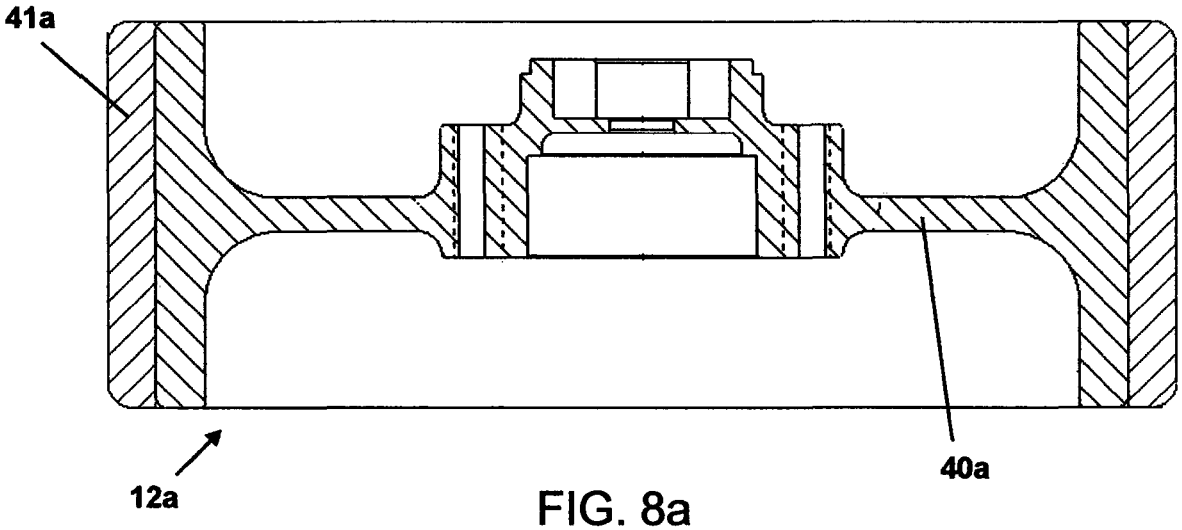
FIG. 8*a* shows a cross-section view from the side of one of the launching wheels, showing detail of central portion and the coating on the outer surface of the central portion, the outer side of the wheel flat in side view cross-section.
Figure 8B:
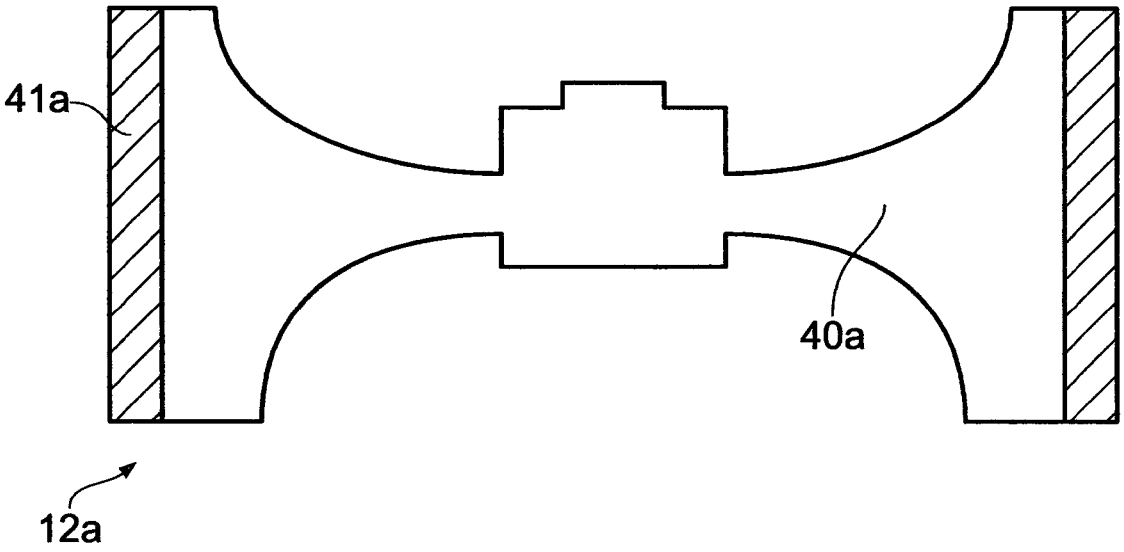
FIG. 8*b* shows a cross-section view from the side of an alternative form of launching wheel, showing detail of the central portion and the coating on the outer surface of the central portion, the outer side of the wheel flat in side view cross-section, the wheel in this alternative form having more material towards the outer part of perimeter of the wheel, and a curved cross sectional profile from the centre outwards towards the perimeter circumference.
Figure 8C:
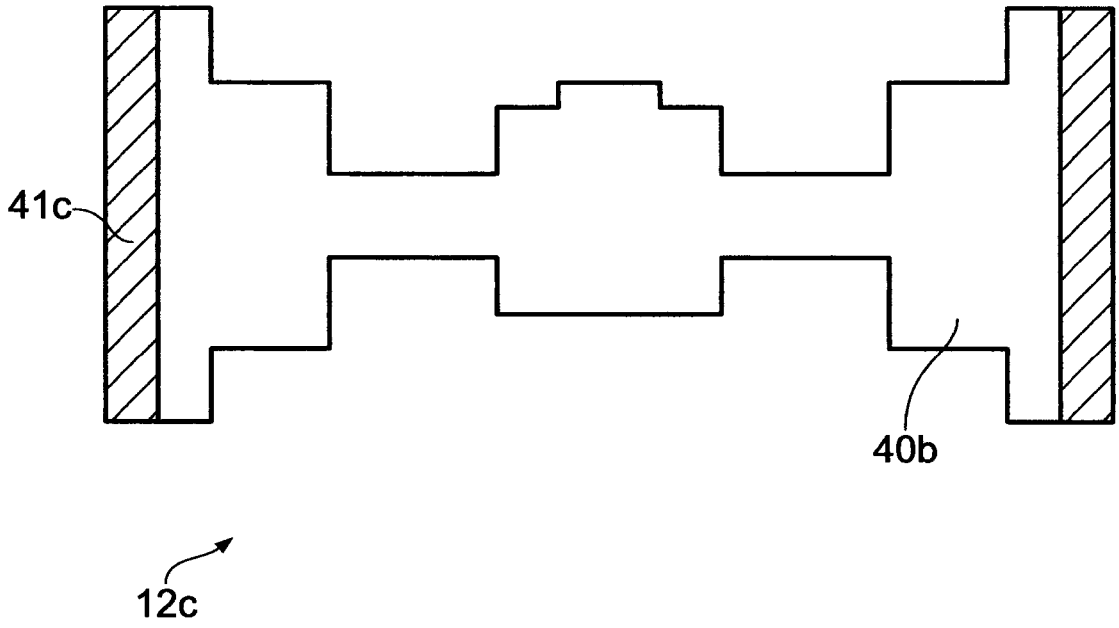
FIG. 8*c* shows a cross-section view from the side of an alternative form of launching wheel, showing detail of the central portion and the coating on the outer surface of the central portion, the outer side of the wheel flat in side view cross-section, the wheel in this alternative form having more material towards the outer part of perimeter of the wheel, and a stepped cross-sectional profile from the centre outwards towards the perimeter circumference.

As shown in FIG. 8*a*, each of the launching wheels 12*a* of the first embodiment has a hollow central body portion so that in cross section from the side, each is generally H-shaped. In alternative forms, as shown in FIGS. 8*b* and 8*c*, the wheels can be shaped to have additional material (and therefore additional weight) towards the outer rim of the wheel, closer to the circumference or perimeter. For example, the wheel could have a curved cross sectional profile, curving from the centre outwards towards the perimeter circumference (wheel 12*b*, as shown in FIG. 8*b*), or the wheel could have a stepped cross-sectional profile from the centre outwards towards the perimeter circumference (wheel 12*c*, as shown in FIG. 8*c*). This provides extra weight towards the rim or circumference of the wheel and this provides additional inertia when the wheel is spinning, which transfers to the ball as increased speed and power for a given speed of the wheel (a heavier wheel, or one with more weight towards the rim, will provide a ball with increased power and speed for the same rotational wheel speed as a lighter wheel, or one of the same weight but with less 'rim' weight). A spindle 20 from the motor passes upward through the centre of the launching wheel to allow the wheel to be directly driven by the motor. The main body 40 of each of the wheels is formed from a hard material such as plastic or aluminium, with the outer surface of each of the wheels having a coating 41 (a rubber coating in the preferred forms), so provide grip on the balls as the pass through the aperture. The rubber coating 41 has a Shore Hardness of substantially between 25 and 40. The edges of the wheel are straight (rather than concave to conform to the ball curve). Straight edges have been found to be advantageous, as the wheel separation can be adjusted so that the ball is squeezed or gripped between the wheels. This has been found to provide greater control and grip during use, as the contacted surface area of the ball is greater and as a consequence the ball is fed through the launcher in the same manner every time. Where 'contact points' or similar phrasing has been used in this specification, this should be taken to mean the surface area of the ball actually in contact. Although this will be an area rather than a point, 'contact point' is used for convenience. In some forms, spring clips 18 extend inwards around the rim of the aperture 11 to assist with centralising the ball as it is fed through, and to help achieve this consistency. The spring clips help to feed the balls into the aperture.

In this embodiment, each of the launching wheels is substantially 8.9 inches in diameter, but can be between 22 and 27 cm.

Figure 15:
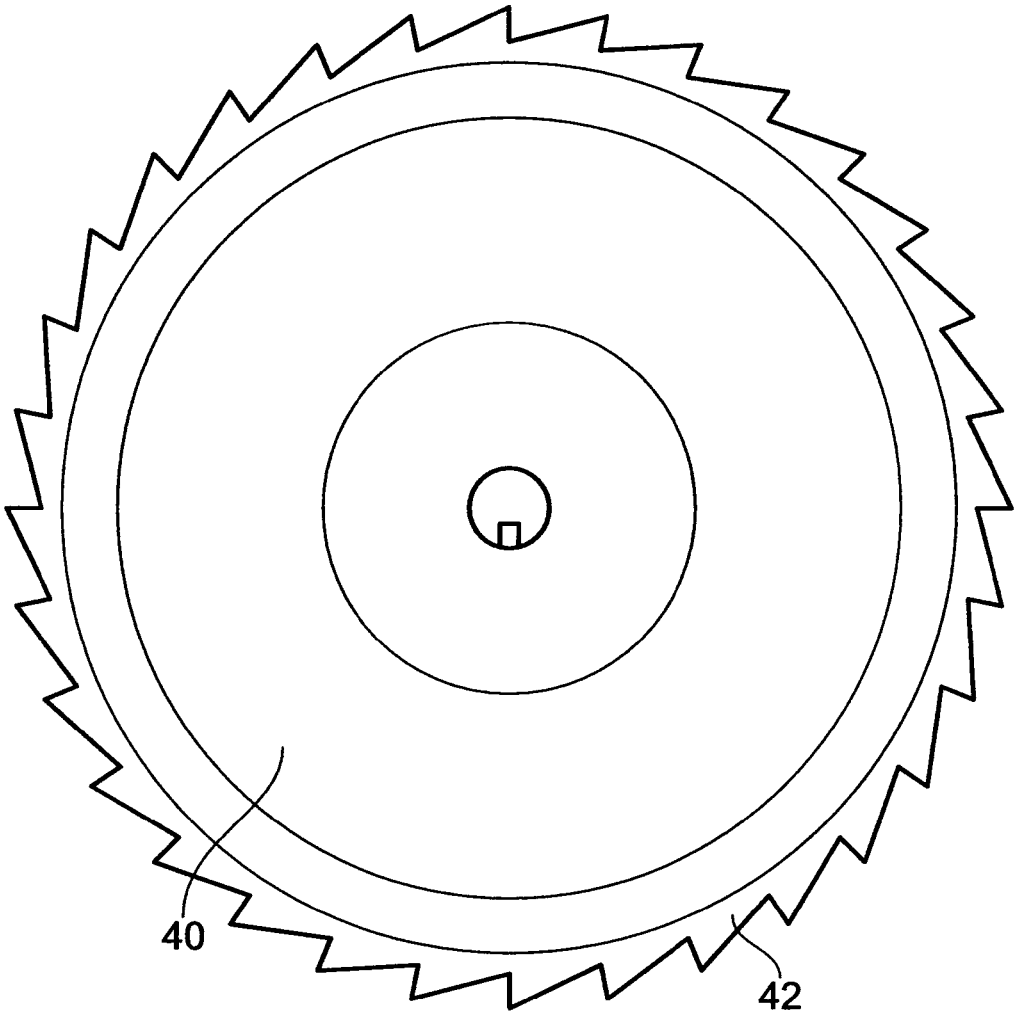
FIG. 15 shows a plan view of an alternate form of launching wheel that can be fitted to the frame as an alternative to the launching wheel of FIG. 8, the outer surface coating of this alternate form forming a saw tooth or ratchet pattern, the pattern configured such that the ramp section of the saw tooth profile leads and contacts the ball surface first in use, ahead of the cliff section, the launching wheel as shown in the figure rotating anti-clockwise.

An alternate form of surface coating 42 can be used, as shown in FIG. 15. The outer surface coating of this alternate form forms a saw tooth or ratchet pattern around the perimeter or circumference of the wheel. The pattern is configured such that the ramp section of the saw tooth profile leads (the launching wheel as shown in FIG. 15 rotating anti-clockwise in use). The ramp section therefore contacts the ball surface first in use, ahead of the trailing cliff section. Using this pattern helps to alleviate surface water build up between the rubber of the firing wheel and the surface of the ball. The angled grooves of the saw tooth pattern encourage a pushing motion on a ball rather than a dragging motion where slip can occur (the ball passing 'upwards' in the plan view of FIG. 15). This coating is formed form rubber having a Shore Hardness of substantially between 25 and 40. This coating can be used with any of the wheels shown in FIG. 8*a*, 8*b*, or 8*c*, or any other form of wheel.

Figure 6:
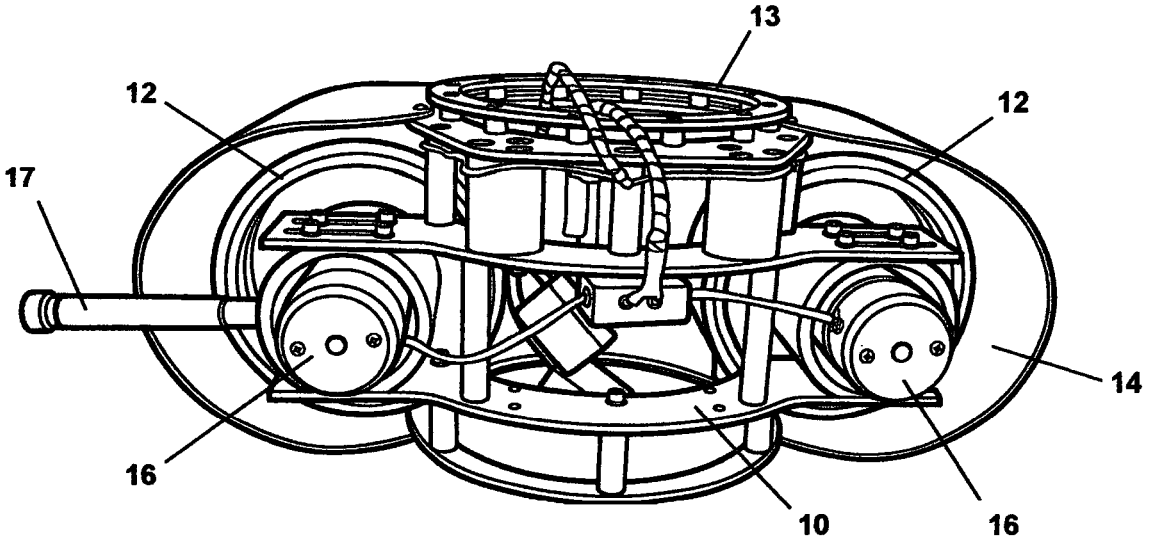
FIG. 6 shows a view from below of the launching section, showing detail of the underside of the frame, the launching wheels and their associated drive motors, and the connection of the cover to the frame.
Figure 7:
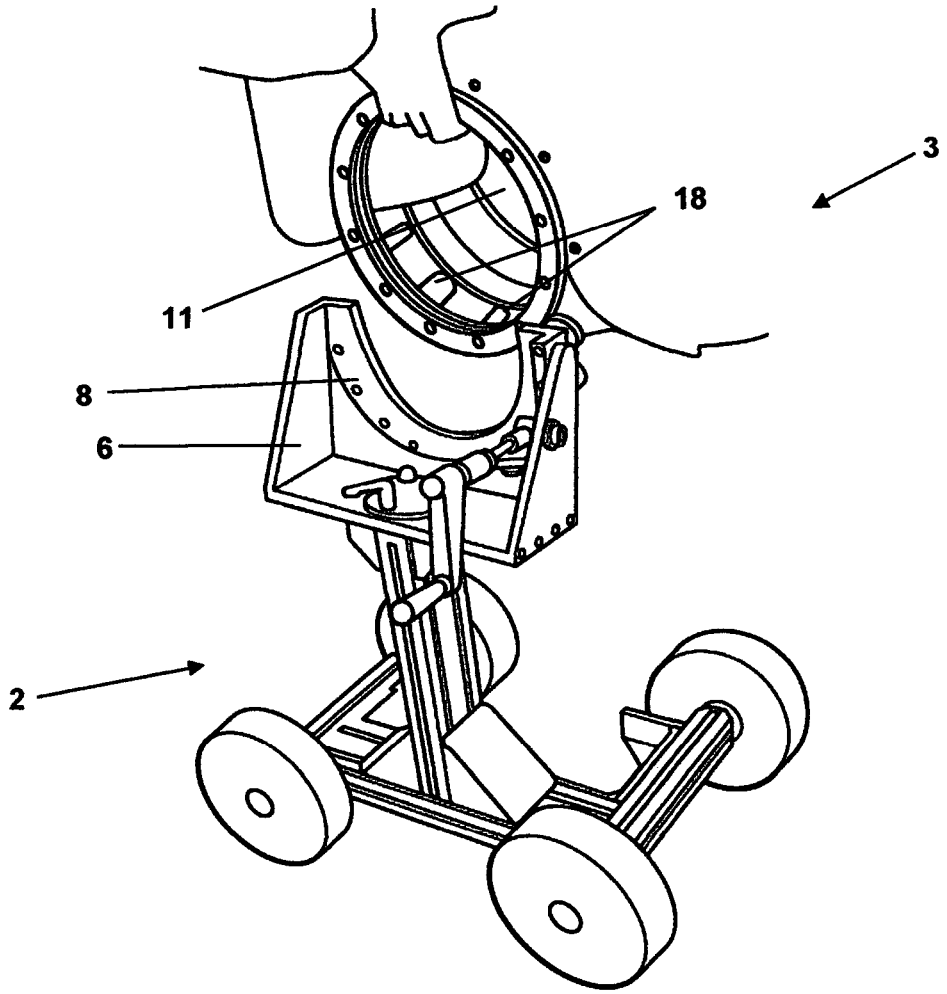
FIG. 7 shows a view from behind and above of the base section and launching section being fitted together, the launching section in this figure fitted with a cover.

As shown in FIGS. 6 and 7, the rear end of that part of the frame 10 that forms the aperture 11 comprises a ring 13 that is connected to the remainder of the frame in such a manner that it extends slightly rearwards away from the remainder of the frame 10. The width of the ring is substantially identical to the width of the central section of each of the bearings 15.

The launching section 3 is mounted to the base section 2 by slotting the ring 13 into the bearings 15 from the top. The diameter of the ring 13 and the position of the bearings 15 on the mounting loop 8 are equivalent, so that the edge of the ring 13 contacts the smaller central section of each of the bearings 15 once slotted in.

The bearings 15 allow the launching section 3 to be rotated from side-to-side around the central axis of the aperture 11. The limits of rotation each way are substantially around 90 degrees. That is, when the axis of the aperture is aligned horizontally, the frame 10 can be rotated about this central axis from a horizontal position where the frame extends horizontally to each side of the aperture, in either a clockwise or counter-clockwise direction, with the frame rotatable through a range of movement at least sufficient to allow the frame to extend substantially vertically at either end of the clockwise or counter-clockwise movement. This can be achieved by pushing or pulling on the frame at each side so that the frame 10 rotates on the rollers. A rotation handle 17*b* is connected to and extends from the frame at one side to allow a user to rotate the frame 10 around a vertical axis. A swivel handle 17*a* extends from one side of the frame 10 to allow the launching section 3 to be rotated from side-to-side around the central axis of the aperture 11. The upper part of the frame 10 is in use enclosed in a housing or casing 14. In an embodiment this can have a an aperture in the top surface to allow a user to grip the housing around the edge of the aperture with their hand to position or remove the launching section 3 from the base section, for transport or storage.

The casing 14 is removable from the frame 10 so that the launching wheels 12 can be accessed.

Figure 9:
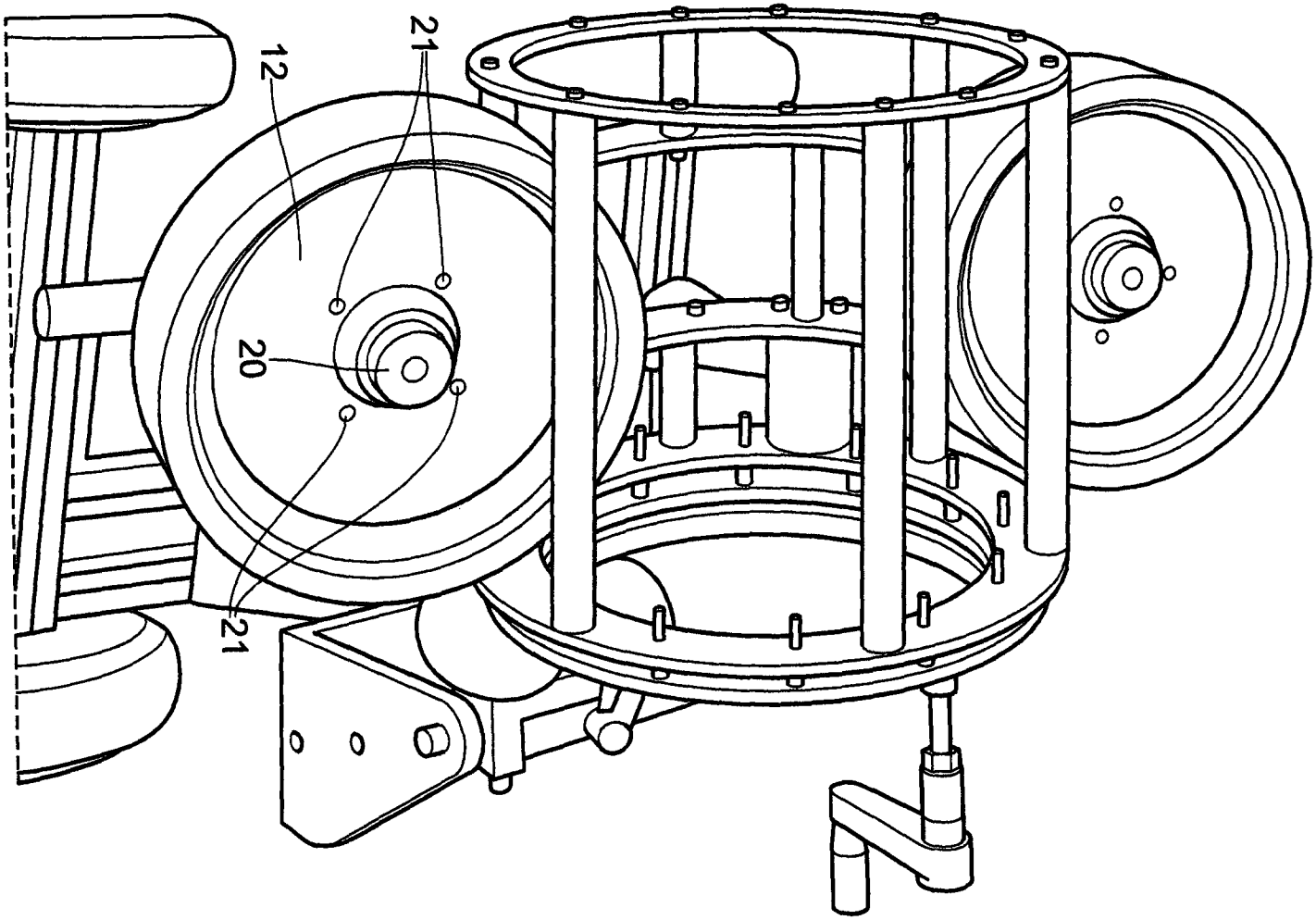
FIG. 9 shows a view from above looking down at the ball launcher of the embodiment of the present invention shown in FIG. 1, with the casing removed, showing detail of the connection of each of the launching wheels to spindles that extend upwards from the drive motors, connection to the spindles achieved via four bolts that extend through the wheel into the spindle.
Figure 10:
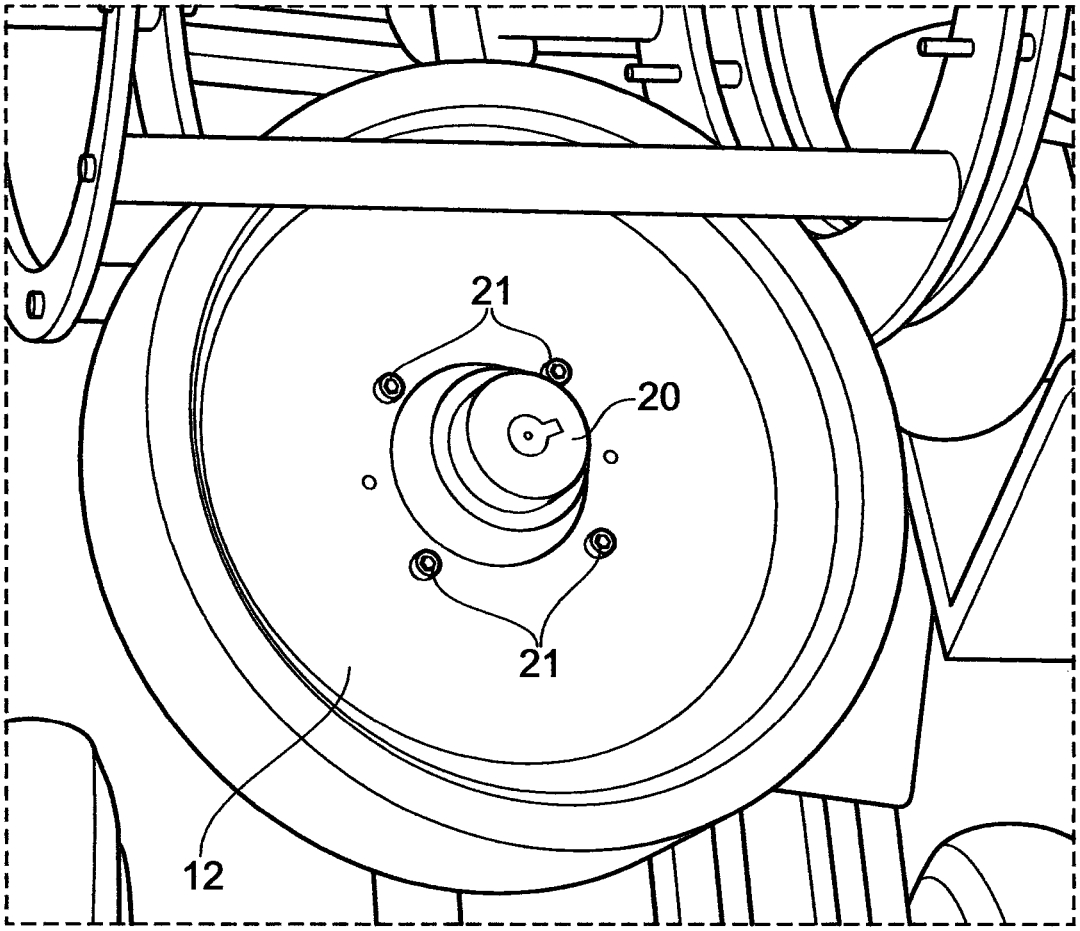
FIG. 10 shows a close up view of the left-hand (or lower in FIG. 9) launching wheel, showing detail of the connection to the spindle by four bolts.

As shown in FIG. 9, each of the launching wheels 12 are attached to their respective spindle 20 via four bolts 21 that pass through the body of the wheel to bolt the wheel to the spindle. The launching wheels 12 can be quickly and easily removed from the spindles 20 once the casing 14 has been removed, by unscrewing the bolts 21 and lifting the firing wheel off the spindle 20. This allows the wheels to be quickly and easily interchanged or swapped over, either for replacement wheels of the same type, or for different wheels that have for example a different coating or tread pattern on the outer surface that contacts the ball in use (e.g. the wet weather balls of FIG. 15), or which have a different size (larger/smaller diameter, or different 'height', and therefore size, of contact area).

Ball Feed

Figure 12A:
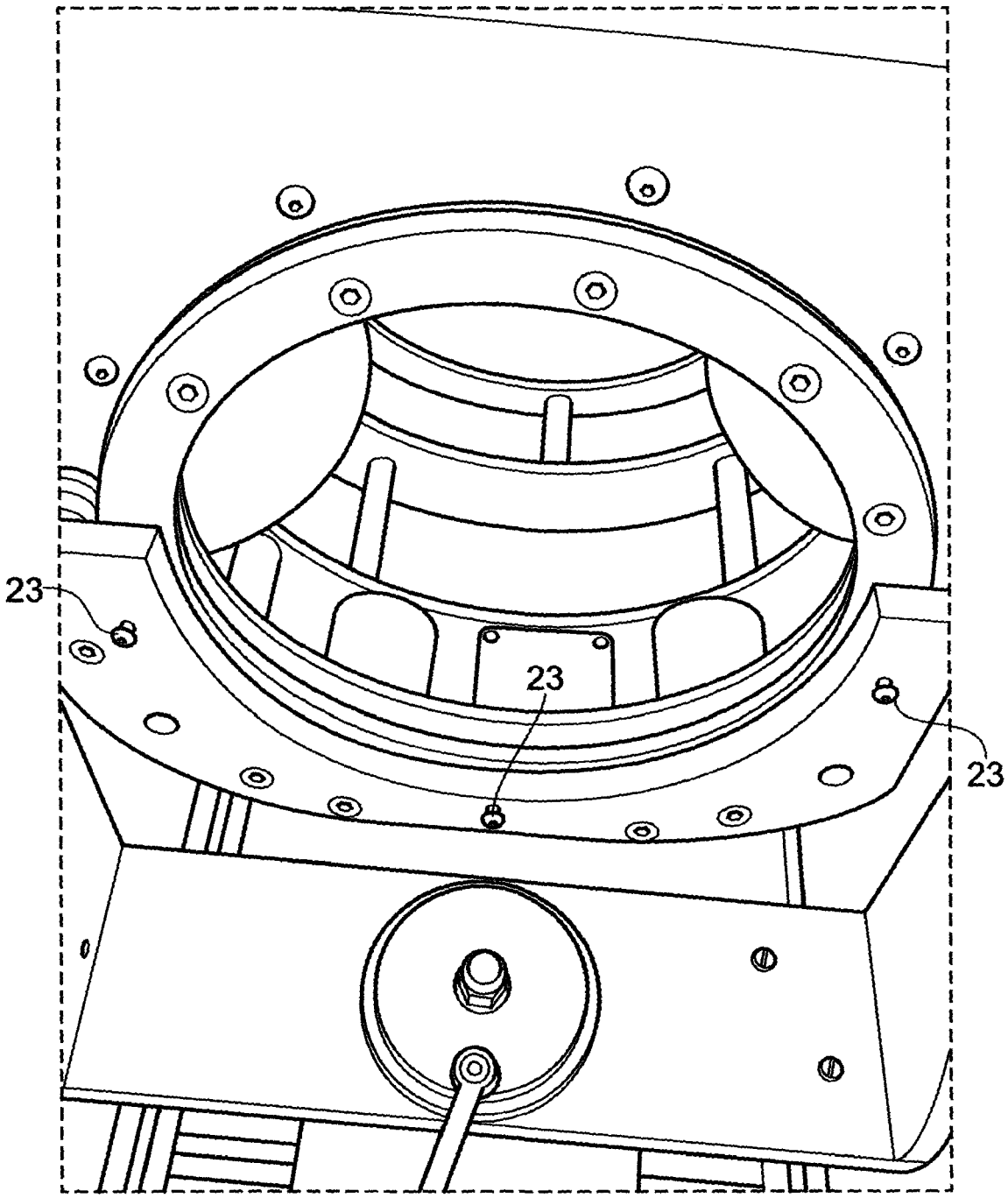
FIG. 12*a* shows a view from directly behind looking forward and down towards the central aperture 11 of a variation of the training device of the previous figures, the mounting loop of this variation having three pins that are connected to and which extend rearwards from the mounting loop, spaced at intervals with one pin at the centre of the mounting loop arc and the remaining two spaced equidistant from the central mounting loop each side of the central pin, the pins having a head wider than the body, the body extending slightly from the mounting loop.
Figure 12B:
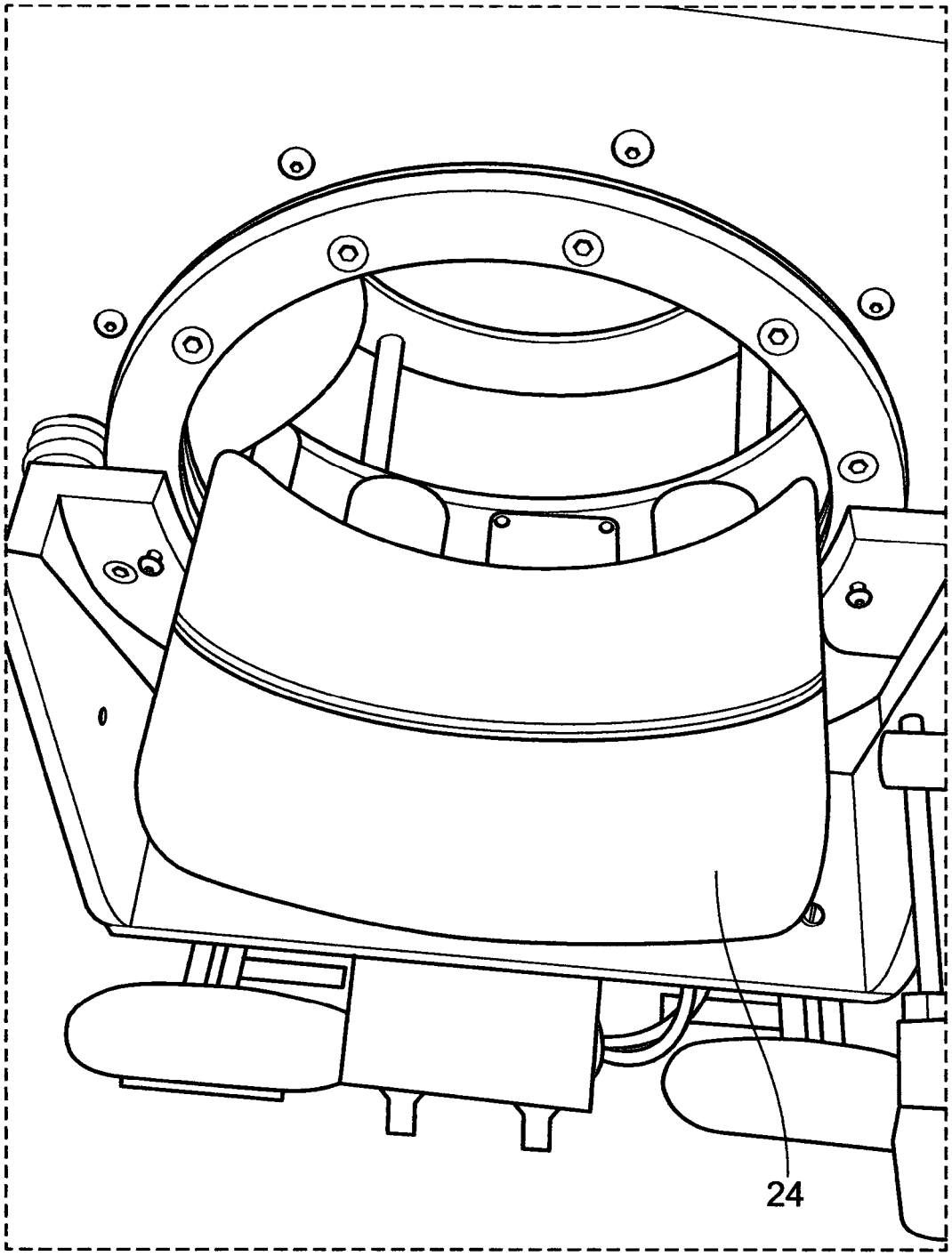
FIG. 12*b* shows a view from the same angle as FIG. 12, showing the same variation of training device, with a ball feed located in place on the pins, the ball feed locating onto the pin heads via a keyhole mechanism to hold the ball feed in position on the mounting loop.
Figure 13:
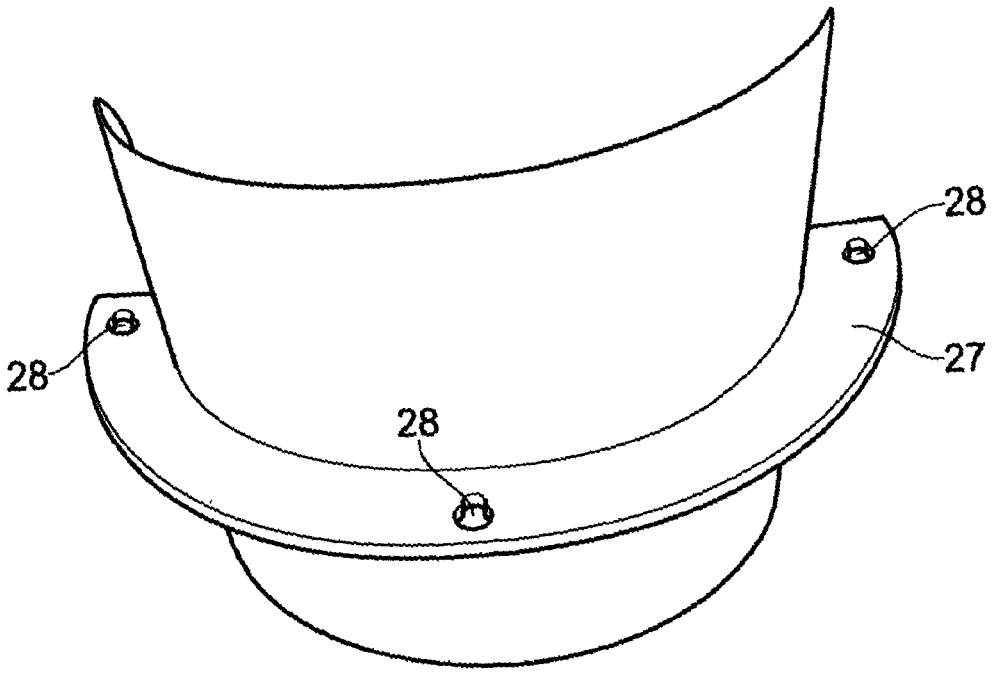
FIG. 13 shows a view from the front and underneath of the ball feed of FIG. 12*b*, showing the semi-cylindrical body of the ball feed, and a flange that extends from the underside of the semi-cylindrical body which contains the holes of the keyhole mechanism.

As shown in FIGS. 12 and 13, in a variation of the launching section 3, the mounting loop has three pins 23 that are connected to the mounting loop and which extend rearwards from the mounting loop. The pins 23 are spaced at intervals with one pin at the centre of the mounting loop arc and the remaining two spaced equidistant from the central mounting loop each side of the central pin. The pins 23 have a head (at the rear of the pin) wider than the shaft or body of the pin that extends forwards and into the mounting loop, and are mounted so that the shaft/body extends slightly from the mounting loop, so there is a gap between the pin head and the mounting loop. The pins 23 allow a ball feed to be mounted to the mounting loop, to feed balls into the aperture 11.

A first form of ball feed 24 is shown in FIGS. 12*a* and 13. The ball feed is semi-cylindrical or has the form of a half-tube, to form a feed ramp that extends rearwards from the aperture when the ball feed is connected to the mounting loop. The ball feed 24 is shaped to guide balls into the aperture 11 for consistent ball delivery, and when connected will angle slightly downwards towards the aperture, so that gravity guides the balls downwards and into the aperture. In this embodiment, the ball feed 24 is formed from plastic by moulding or similar. The ball feed 24 locates onto the pins 23, the ball feed 24 has a flange 27 on the underside, the front face of the flange 27 resting against the rear face of the mounting loop, the flange 27 having three apertures 28 that form a keyhole mechanism along with the pins 23 to hold the ball feed 24 in position on the mounting loop—that is, the ball feed 24 'hooks' onto the pins 23 via the apertures 28. It can be seen that the ball feed will always remain in the same consistent ball delivery position when the head section is rotated around it using handle 17*b*. The ball feed also remains in place when elevation is applied using handle 9 and swivel is applied using handle 17*a*.

Figure 14A:
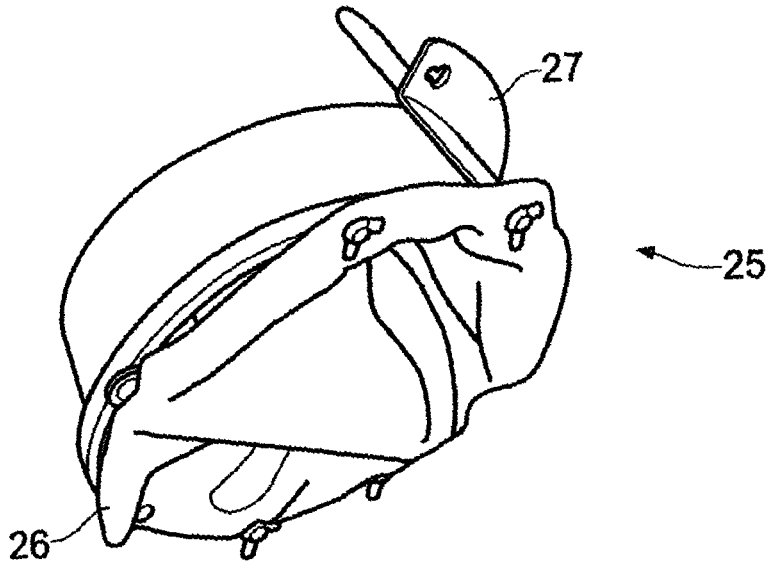
FIG. 14*a* shows a variation of the ball feed of FIG. 13, the ball feed in this variation having a rear section that forms a tube or ring, and having an absorbent cloth connected around the ring and hanging loosely so that a ball passing through the ball feed will be wiped by the cloth as it passes through, the ball feed of this variation connecting to the mounting loop in the same manner as for the variation of FIG. 13.

In a second form, as shown in FIG. 14, the ball feed 25 is formed as a full tube or ring at the rear, with the half-tube or semi-cylindrical section extending from the front. A tube of moisture-absorbent cloth 26 from a toweling material or similar is connected around the perimeter of the ring at the rear, the cloth hanging loosely so that a ball passing through the ball feed will pass through the ring of cloth as it passes through the ring at the rear, and will be wiped by the cloth as it passes through. The ball feed 25 of this variation connects to the mounting loop in the same manner as for the variation of FIG. 13, via flange 27.

Figure 14B:
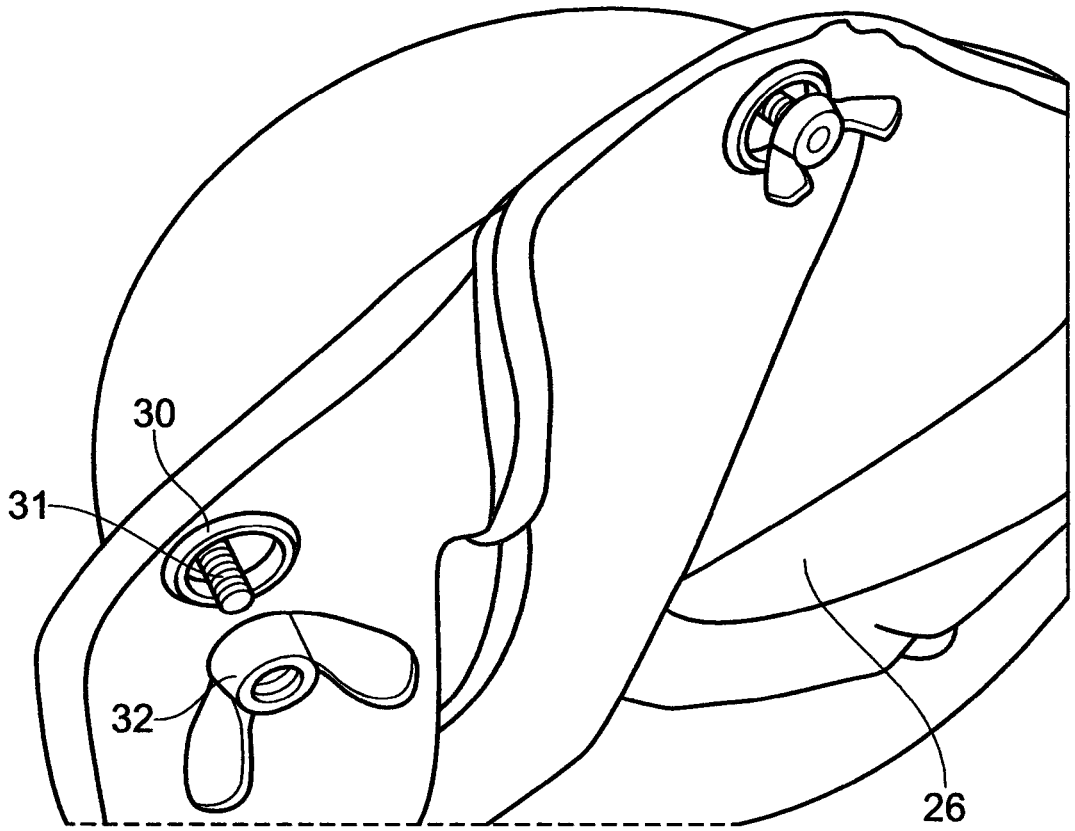
FIG. 14*b* shows detail of the way in which the absorbent cloth is connected to the rear of the ring.

The cloth is connected to the rear of the full tube section as follows, and as shown in FIG. 14*b*: the cloth has six to eight grommets 30 that are connected to the cloth 26, and which pass through the cloth 26. The rear of the ring has six to eight equivalent threaded extensions 31 that extend rearwards from the ring. The cloth 26 is located at the rear of the ring so that the extensions 31 pass through the grommets 30. Wing nuts 32 are then screwed over the threaded extensions 31 to secure the cloth in position. This allows the cloth to be quickly and easily removed for washing and reuse. Different numbers of grommets could also be used (e.g. four or ten) in variations, as required.

In use, a user can assemble the device 1 and make this ready by connecting the launching section 3 to the base section 4 in the manner described above, and then wheeling the device 1 to the required location (alternatively, the two parts can be separately transported to the required location and then assembled). The required adjustments are made: the launching wheels 12 are moved to the correct separation, the motor(s) is/are set to the required speed, the launching section 3 is adjusted to the required angles in both the vertical and horizontal planes by way of rotation on the mounting pole 5, and the handles 7, 9, and the frame 10 is rotated as required around the aperture axis by way of the handle 17. Balls are then fed into the aperture, with these driven through the aperture 11 by the launching wheels 12, to be propelled out or thrown from the front of the launching section 3. The balls are driven or propelled linearly through the launching section—that is, along a linear axis. Once clear of the device 1, gravity and ambient conditions (e.g. wind, atmosphere) will act on the ball to change it's trajectory, but the initial propulsion through the device is linear. Depending on the angles of adjustment of the launching section, and the speed of the launching wheels, the balls will have different flight characteristics. A user can choose different speeds and directions of delivery, and can change between deliveries that have left spin, right spin, top and back spin. These spins create commonly observed deliveries such as outswingers, inswingers, curling free kicks, dipping shots and lofted passes. All types of spin used in games (sidespin, topspin, backspin and knuckleballs) can be accurately simulated.

The launching wheels can be spun at up to 4000 rpm with a motor of the appropriate power selected for and used with the device. This allows shots to be delivered with speeds from 5 mph up to 95 mph. Different elevations of ball flight can be achieved, with a user controlling the launch angle from angles of substantially −10 degrees to +35 degrees to the horizontal plane, by altering the angle of the mounting loop 8 using the worm gear handle 9. 35 degrees upwards allows for long shots, and 10 degrees downwards allows for ground shots and 'bouncer ball' replication. The launching wheels in the preferred embodiment can be independently controlled up to a speed of substantially 4000 rpm, or the wheels can be slaved to achieve identical rotation speeds. Different rotations speeds allow balls to be launched with spin.

The ability to alter the distance that firing wheels are situated apart allows the device 1 to accommodate internationally accepted football sizes (i.e. size 3 (circumference of 23-24 inches), futsal (circumference of 24-25 inches), size 4 (circumference of 25-26 inches), and size 5 (circumference of 27-28 inches)). This allows for training from six-year old up to adult. Size 3 balls are the smallest balls and are generally used for children under the age of 8. These balls are generally 23-24 inches in circumference and weigh between 11-12 ounces. Size 4 balls are used for players between the ages of 8-12, and weigh between 12-13 ounces and have a circumference of 25-26 inches. Size 5 is the international standard match ball for all ages 12 and older, including all adult play. The size 5 ball weighs between 14-16 ounces with a circumference of 27-28 inches.

As the launching section or head is rotatable about the central axis of the aperture 11, the axis remains stationary and does not move from side to side around an offset pivot point or axis. This is highly advantageous as it allows adjustments or minor changes to be made to particular shots, and for any change to be made with greater precision than would otherwise be possible. This is also highly advantageous if a ball hopper or feeder is used, as the connection between the feeder and the aperture does not have to move—the ball exit of the hopper does not have to move with or 'chase' the aperture.

A training device 1 according to the invention is advantageous as the launching section can be rotated around the axis of the aperture through 180 degrees (from vertical one way to vertical the other) extremely quickly—in around two seconds, using a single hand only. This has the advantage, among others, of allowing users to take advantage of the Magnus Effect with regards to the flight of the ball, and when this is combined with a set wheel speed it can immediately change the place of delivery of the ball without needing to change the relative wheel speeds, and without resorting to the use of pulling out pins, unscrewing clamps or anything else. Different types of spin can be imparted on the ball if the firing wheels rotate at differing speeds, and this can be combined with the position of the firing wheels (by rotation around the aperture axis) to create a wide variety of ball flight characteristics and spin types. The output is the ability to create top and back spin, side spin in both directions and anything in between.

All of the functionality of the machine to define ball delivery can be used quickly, in parallel as well as interchangeably. For example a skilled user could launch a ball to the left with top spin and within a short space of time such as around three to four seconds launch a ball to the right with backspin.

Balls are delivered consistently to the same designated spot at the same speed. Variations in ball flight will only occur due to differing inflation pressures or different panel arrangements that affect the ball's aerodynamics (known as the 'Magnus effect'). This means that every ball delivered from a corner, cross, free kick or shot for example is a "good ball" for coaches to facilitate training and practice.

The use of a 12V battery as outlined above has been found to deliver over 5 hours of field play when fully charged. The battery can be easily swapped out for a fresh battery, to allow the machine to be used for up to ten hours constant player training over the course of the day. Generally, batteries of this type take around five hours to fully discharge.

Using the device 1 alleviates the present need for coaches to manually deliver balls to players. This allows coaches to concentrate more on improving the techniques and core skills of their squads rather than concentrating on how to deliver balls to them. This not only benefits players, but it also lessens the impact of RSI on coaches knees and backs in particular, or any other type of injury.

The device 1 can be disassembled as outlined above, with a user detaching the launching section from the base section for transportation or storage. This enables a user to fit the device 1 into a small area such as the boot of a car, if needed. The frame design keeps the weight low. The product can separate into two parts and the maximum weight of each is around 25 Kg. Separation into two parts also helps with portability.

Additional items can be used with the device 1 as required. For example, an automatic ball feeder and hopper, a control system that can be set to fire shots randomly or semi-randomly (e.g. within or towards a set area such as for example a goal mouth, a remote control, and a real-time video camera feed for player analysis.

In variations of the embodiment described above, the frame of the launching section 3 could be formed so that a u-channel or similar is formed in the launching section in place of the aperture. Where 'aperture' is used in this specification, this should be taken as a closed tunnel-type aperture, as for the embodiment described above, or as a open-topped u-channel or similar. In the embodiment described above, a pair of launching wheels are used. Three or more wheels could be used in variations, or any suitable launching means could be used that contacts the ball at spaced apart points or locations to drive or launch the ball.

In the embodiment described above, the base section forms a supporting means for the launching section. The launching section could be mounted on any suitable type of supporting means.

The ring 14 as described above for the preferred embodiment is a full circular loop. This could also be a circular segment, either with a centre co-located with the axis of the aperture, or offset (the diameter of the circle of which the segment forms a part could be significantly larger than the diameter of the aperture, so that the angle is adjusted more by rocking than by rotation).

The invention claimed is:

1. A training device for ball sports, comprising:

a launching structure comprising an aperture having a central axis, the aperture being sized and shaped to allow balls to pass linearly through the aperture along the central axis thereof:

a launching mechanism configured to contact a ball within the aperture at a plurality of contact locations spaced around a surface of the ball, and to drive the ball through the aperture, the launching mechanism comprising a plurality of launching wheels connected to the launching structure so that each launching wheel partly extends into the aperture to contact a ball therein, the launching wheels being configured to rotate in use to drive the ball through the aperture;

a supporting structure configured to support the launching structure above a surface; and wherein the launching structure and the supporting structure are configured such that in use the launching structure can be rotated around the central axis of the aperture to alter the positions of the contact locations.

2. The training device as claimed in claim 1, wherein the plurality of launching wheels comprises a pair of launching wheels at diametrically opposed locations.

3. The training device as claimed in claim 2, wherein the launching structure further comprises at least one motor configured to drive the pair of launching wheels.

4. The training device as claimed in claim 3, wherein the at least one motor and the launching wheels are configured so that the launching wheels can be driven at different speeds.

5. The training device as claimed in claim 2, wherein the spacing between the pair of launching wheels can be altered.

6. The training device as claimed in claim 2, wherein sides of each launching wheels are substantially straight.

7. The training device as claimed in claim 2, wherein the sides of each launching wheel comprises a gripping rubber layer.

8. The training device as claimed in claim 7, wherein the rubber layer comprises a saw tooth pattern around a perimeter of the respective launching wheel.

9. The training device as claimed in claim 8, wherein the saw tooth pattern has a ramp section which leads in use.

10. The training device as claimed in claim 1, wherein the launching structure comprises a frame forming the aperture and extending to each side of the aperture.

11. The training device as claimed in claim 10, wherein the supporting structure and launching structure are mutually configured for removable connection.

12. The training device as claimed in claim 1, wherein the supporting structure comprises a stand configured to rest on a surface and to extend upwards from the surface to connect with and support the launching structure.

13. The training device as claimed in claim 12, wherein the launching structure comprises a frame including a circular segment forming a rearward portion of the aperture.

14. The training device as claimed in claim 13, wherein the circular segment comprises a ring.

15. The training device as claimed in claim 13, wherein the stand further comprises a plurality of bearings, configured to connect with the circular segment to detachably mount the launching structure on the stand, and to allow the launching structure to be rotated around the central axis of the aperture to alter the positions of the contact locations.

16. The training device as claimed in claim 15, wherein the bearings are mounted on the stand, wherein each bearing forming a channel into which an outer edge of the circular segment is positioned, the circular segment moveable within the channel of each bearing to rotate the launching structure.

17. The training device as claimed in claim 15, wherein each bearing is formed so as to appear circular in front or rear view, and H-shaped in side view, wherein the H-shape of each bearing defines a channel having a width which is substantially the same as a thickness of the circular segment.

18. The training device as claimed in claim 15, wherein the stand further comprises a mounting loop, the bearings connected to a face of the mounting loop.

19. The training device as claimed in claim 18, wherein eight bearings are arranged in pairs along a length of the mounting loop, each bearing connected so as to rotate around a central axis of rotation of each bearing.

20. The training device as claimed in claim 18, wherein the stand and the mounting loop are configured so that the mounting loop can be rotated in both horizontal and vertical planes.

* * * * *